US009855755B2

(12) United States Patent
Kawate

(10) Patent No.: US 9,855,755 B2
(45) **Date of Patent: *Jan. 2, 2018**

(54) LIQUID SUPPLY SET, LIQUID SUPPLY APPARATUS, AND LIQUID EJECTION SYSTEM

(71) Applicant: Seiko Epson Corporation, Tokyo (JP)

(72) Inventor: Hiroyuki Kawate, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/125,291

(22) PCT Filed: Mar. 13, 2015

(86) PCT No.: PCT/JP2015/001422

§ 371 (c)(1),
(2) Date: Sep. 12, 2016

(87) PCT Pub. No.: WO2015/136942

PCT Pub. Date: Sep. 17, 2015

(65) Prior Publication Data

US 2017/0072699 A1 Mar. 16, 2017

(30) Foreign Application Priority Data

Mar. 14, 2014 (JP) ..... 2014-051787
Mar. 14, 2014 (JP) ..... 2014-051789
(Continued)

(51) Int. Cl.
*B41J 2/175* (2006.01)

(52) U.S. Cl.
CPC ..... *B41J 2/17526* (2013.01); *B41J 2/175* (2013.01); *B41J 2/1752* (2013.01);
(Continued)

(58) Field of Classification Search
CPC B41J 2/17526; B41J 2/17509; B41J 2/17513; B41J 2/17523; B41J 2/17553;
(Continued)

(56) References Cited

U.S. PATENT DOCUMENTS 5,860,363 A 1/1999 Childers et al.
6,203,147 B1 3/2001 Battey et al.
(Continued)

FOREIGN PATENT DOCUMENTS

CN 101585265 A 11/2009
JP 59-212272 A 12/1984
(Continued)

*Primary Examiner* — Henok Legesse
(74) *Attorney, Agent, or Firm* — Workman Nydegger

(57) ABSTRACT

Provided is an ink supply set configured to detach from a liquid supply apparatus and includes an ink containing portion, a connection unit, an ink guiding portion having an engaging portion, a flow path unit that guides the ink in the ink containing portion to the ink guiding portion, a circuit board, and a substrate installation portion. The liquid supply apparatus includes a liquid introduction portion into which ink is introduced via the ink guiding portion, and a movable support portion that supports the connection unit. In a state in which the engaging portion is engaged with a first engaged portion formed in the movable support portion, the circuit board comes into contact with an electrical connection portion provided in the liquid supply apparatus, and in the removed position, the circuit board is separated from the electrical connection portion.

8 Claims, 20 Drawing Sheets

(30) Foreign Application Priority Data

| | | |
|---|---|---|
| Mar. 14, 2014 | (JP) | 2014-051791 |
| Mar. 14, 2014 | (JP) | 2014-051907 |
| Sep. 12, 2014 | (JP) | 2014-186042 |

(52) U.S. Cl.
CPC ..... *B41J 2/17509* (2013.01); *B41J 2/17513* (2013.01); *B41J 2/17523* (2013.01); *B41J 2/17546* (2013.01); *B41J 2002/17516* (2013.01)

(58) Field of Classification Search
CPC . B41J 2/1752; B41J 2/175; B41J 2002/17516
See application file for complete search history.

(56) References Cited

U.S. PATENT DOCUMENTS

| | | | |
|---|---|---|---|
| 6,375,315 | B1 | 4/2002 | Steinmetz et al. |
| 6,416,166 | B1 | 7/2002 | Robinson et al. |
| 7,891,789 | B2 | 2/2011 | Hibbard et al. |
| 8,757,781 | B2 | 6/2014 | Ishizawa et al. |
| 8,960,871 | B2 | 2/2015 | Karasawa et al. |
| 9,139,011 | B2 | 9/2015 | Ishizawa et al. |
| 9,259,936 | B2 | 2/2016 | Iwamuro et al. |
| 2003/0222940 | A1 | 12/2003 | Seino et al. |
| 2005/0001888 | A1 | 1/2005 | Seino et al. |
| 2007/0206076 | A1 | 9/2007 | Seino et al. |
| 2009/0290001 | A1 | 11/2009 | Domae |
| 2014/0063145 | A1 | 3/2014 | Iwamuro et al. |
| 2015/0352850 | A1 | 12/2015 | Ishizawa et al. |
| 2017/0072700 | A1* | 3/2017 | Ishizawa ..... B41J 2/1752 |

FOREIGN PATENT DOCUMENTS

| | | | |
|---|---|---|---|
| JP | 11-348303 | A | 12/1999 |
| JP | 2002120382 | A | 4/2002 |
| JP | 2004-168341 | A | 6/2004 |
| JP | 2006-069030 | A | 3/2006 |
| JP | 2007-090646 | A | 12/2007 |
| JP | 2010058525 | A | 3/2010 |
| JP | 2012-116202 | A | 6/2012 |
| JP | 2012-116202 | A | 6/2012 |
| JP | 2012116102 | A | 6/2012 |
| JP | 2012158343 | A | 8/2012 |
| JP | 2013-212706 | A | 10/2013 |
| WO | 2006/072038 | A1 | 7/2006 |
| WO | 2014-034111 | A | 3/2014 |
| WO | 2014/034111 | A1 | 3/2014 |

* cited by examiner

LIQUID SUPPLY SET, LIQUID SUPPLY APPARATUS, AND LIQUID EJECTION SYSTEM

CROSS REFERENCE TO RELATED APPLICATIONS

This application claims priority under 35 U.S.C. §119 on Japanese Patent Application No. 2014-186042, filed Sep. 12, 2014, and on Japanese Patent Application Nos. 2014-051787, 2014-051789, 2014-051791 and 2014-051907, each filed on Mar. 14, 2014. The entire content of each such application is incorporated by reference herein.

TECHNICAL FIELD

The present invention relates to a liquid supply set, a liquid supply apparatus, a liquid ejection system, and the like.

BACKGROUND ART

Conventionally, an inkjet printer has been known as an example of a liquid ejection apparatus. In general, with an inkjet printer, printing can be performed on a recording medium by ejecting ink, which is an example of a liquid, from a recording head onto a recording medium such as a sheet. Conventionally, an ink supply bag has been known as an ink supply means (liquid supply means) capable of supplying ink to this kind of printer (e.g., see PTL 1).

CITATION LIST

Patent Literature

PTL 1: WO 2006/072038

SUMMARY OF INVENTION

Technical Problem

With the ink supply bag disclosed in PTL 1, an ink bag (an example of a liquid containing portion) containing ink, which is an example of a liquid, and a guiding portion that guides the ink in the ink bag to the exterior are integrally coupled together. With this configuration, in the ink supply bag, the ink bag and the guiding portion cannot be made independent of each other and replaced individually. For this reason, when the guiding portion is damaged or the like, for example, it is not possible to replace only the guiding portion with a new leading portion. In this case, the ink in the ink bag is likely to go to waste. Thus, the known liquid supply means is problematic in that the liquid is likely to go to waste.

Solution to Problem

The present invention can be used to solve at least the above-described problem, and is realized using the following modes or application examples.

Application Example 1

A liquid supply set configured to detach from a liquid supply apparatus that supplies a liquid to a liquid ejection apparatus, including: a liquid containing portion configured to contain the liquid; a connection unit configured to detach from the liquid supply apparatus; a liquid guiding portion provided in the connection unit; a flow path connection portion that is provided in the connection unit and communicates with the liquid guiding portion; a flow path unit that constitutes a flow path that connects the liquid containing portion and the flow path connection portion and is configured to guide the liquid in the liquid containing portion to the liquid guiding portion via the flow path connection portion; an electrical contact portion configured to come into contact with an electrical connection portion provided in the liquid supply apparatus; and a holding portion that is provided in the connection unit and is configured to hold the electrical contact portion, wherein the liquid guiding portion includes a first engaging portion configured to engage with the liquid supply apparatus, the liquid supply apparatus includes a liquid introduction portion into which the liquid in the liquid containing body is introduced via the liquid guiding portion, and a movable support portion configured to support the connection unit, a first engaged portion with which the first engaging portion of the liquid guiding portion engages is formed in the movable support portion, in a state in which the first engaging portion of the liquid guiding portion is engaged with the first engaged portion, the movable support portion is displaced from a removed position in which the liquid guiding portion and the liquid introduction portion are separated from each other to a connected position in which the liquid guiding portion and the liquid introduction portion are connected to each other, and in a state in which the first engaging portion of the liquid guiding portion is engaged with the first engaged portion, the electrical contact portion comes into contact with the electrical connection portion in the connected position, and is separated from the electrical connection portion in the removed position.

With the liquid supply set according to this application example, the liquid guiding portion and the liquid containing portion are independent of each other. Also, with this liquid supply set, the liquid guiding portion and the liquid containing portion are in communication via a flow path unit. For this reason, the liquid guiding portion and the liquid containing portion can each be replaced individually. Accordingly, for example, when the liquid guiding portion is damaged or the like, it is possible to replace only the connection unit with a new connection unit. For this reason, with this liquid supply set, it is easy to avoid a case in which the liquid in the liquid containing portion goes to waste. Also, for example, when the liquid containing portion is damaged or the like, it is possible to replace only the liquid containing portion with a new liquid containing portion. For this reason, with this liquid supply set, it is easy to avoid a case in which a constituent component other than the liquid containing portion goes to waste.

Application Example 2

The above-described liquid supply set, in which at least part of the liquid containing portion is flexible.

In this application example, at least part of the liquid containing portion is flexible, and therefore it is possible to reduce a drop in pressure in the liquid containing portion that occurs when the liquid in the liquid containing portion is consumed.

Application Example 3

In the above-described liquid supply set, the liquid containing portion is provided with an air communication path through which air is introduced into the liquid containing portion.

In this application example, air can be introduced into the liquid containing portion via an air communication path, and therefore it is possible to reduce a drop in pressure in the liquid containing portion that occurs when the liquid in the liquid containing portion is consumed.

Application Example 4

In the above-described liquid supply set, the liquid containing portion is provided with a liquid introduction path through which liquid is introduced into the liquid containing portion.

In this application example, a liquid can be introduced into the liquid containing portion via the liquid introduction path, and therefore new liquid can be injected into the liquid containing portion.

Application Example 5

A liquid supply apparatus that supplies a liquid to a liquid ejection apparatus, including: a liquid containing portion configured to contain the liquid; a liquid introduction portion into which the liquid is introduced from the liquid containing portion; a connection unit configured to connect to the liquid introduction portion; a liquid guiding portion provided in the connection unit; a flow path connection portion that is provided in the connection unit and communicates with the liquid guiding portion; a flow path unit that constitutes a flow path that connects the liquid containing portion and the flow path connection portion and is configured to guide the liquid in the liquid containing portion to the liquid guiding portion via the flow path connection portion; an electrical connection portion; an electrical contact portion configured to come into contact with the electrical connection portion; a holding portion that is provided in the connection unit and is configured to hold the electrical contact portion; and a movable support portion configured to detachably support the connection unit, wherein the liquid guiding portion includes a first engaging portion configured to engage with the movable support portion, a first engaged portion with which the first engaging portion of the liquid guiding portion engages is formed in the movable support portion, in a state in which the first engaging portion of the liquid guiding portion is engaged with the first engaged portion, the movable support portion is displaced from a removed position in which the liquid guiding portion and the liquid introduction portion are separated from each other, to a connected position at which the liquid guiding portion and the liquid introduction portion are connected to each other, and in a state in which the first engaging portion of the liquid guiding portion is engaged with the first engaged portion, the electrical contact portion comes into contact with the electrical connection portion in the connected position, and is separated from the electrical connection portion in the removed position.

With the liquid supply apparatus according to this application example, the liquid guiding portion and the liquid containing portion are independent of each other. Also, with this liquid supply apparatus, the liquid guiding portion and the liquid containing portion are in communication via the flow path unit. For this reason, the liquid guiding portion and the liquid containing portion can each be replaced individually. Accordingly, for example, when the liquid guiding portion is damaged or the like, it is possible to replace only the liquid guiding portion with a new liquid guiding portion by replacing the connection unit. For this reason, with this liquid supply apparatus, it is easy to avoid a case in which the liquid in the liquid containing portion goes to waste. Also, for example, when the liquid containing portion is damaged or the like, it is possible to replace only the liquid containing portion with a new liquid containing portion. For this reason, according to the liquid supply apparatus, it is easy to avoid a case in which a constituent component other than the liquid containing portion goes to waste. Also, with this liquid supply apparatus, in a state in which the first engaging portion of the liquid guiding portion is engaged with the first engaged portion of the movable support portion, the movable support portion is displaced from the removed position to the connected position, whereby the liquid guiding portion can be connected to the liquid introduction portion and the electrical contact portion can be brought into contact with the electrical connection portion. Accordingly, it is possible to reduce operations related to mounting compared to the case of independently carrying out the connection of the liquid guiding portion and the liquid introduction portion and the contact between the electrical contact portion and the electrical connection portion.

Application Example 6

The above-described liquid supply apparatus, in which a cover that covers the liquid containing portion is included.

In this application example, the liquid containing portion can be covered with the cover, and therefore the liquid containing portion can be protected by the cover. Accordingly, it is easy to avoid a case in which dust and the like attaches to the liquid containing portion and a case in which the liquid containing portion is damaged, for example.

Application Example 7

The above-described liquid supply apparatus, in which the cover covers the flow path unit.

In this application example, the flow path unit can be covered with the cover, and therefore the flow path unit can be protected by the cover. Accordingly, it is easy to avoid a case in which dust and the like attaches to the flow path unit and a case in which the flow path unit is damaged, for example.

Application Example 8

A liquid ejection system, including: the above-described liquid supply apparatus; a liquid ejection portion configured to eject the liquid supplied from the liquid supply apparatus via the liquid introduction portion; and a pump that is provided between the liquid introduction portion and the liquid ejection portion, and is configured to provide pressure to the liquid from the liquid introduction portion side to the liquid ejection portion side.

With the liquid ejection system according to this application example, the supply of the liquid from the liquid supply apparatus to the liquid ejection apparatus can be assisted using a pump.

DESCRIPTION OF EMBODIMENTS

Figure 1:
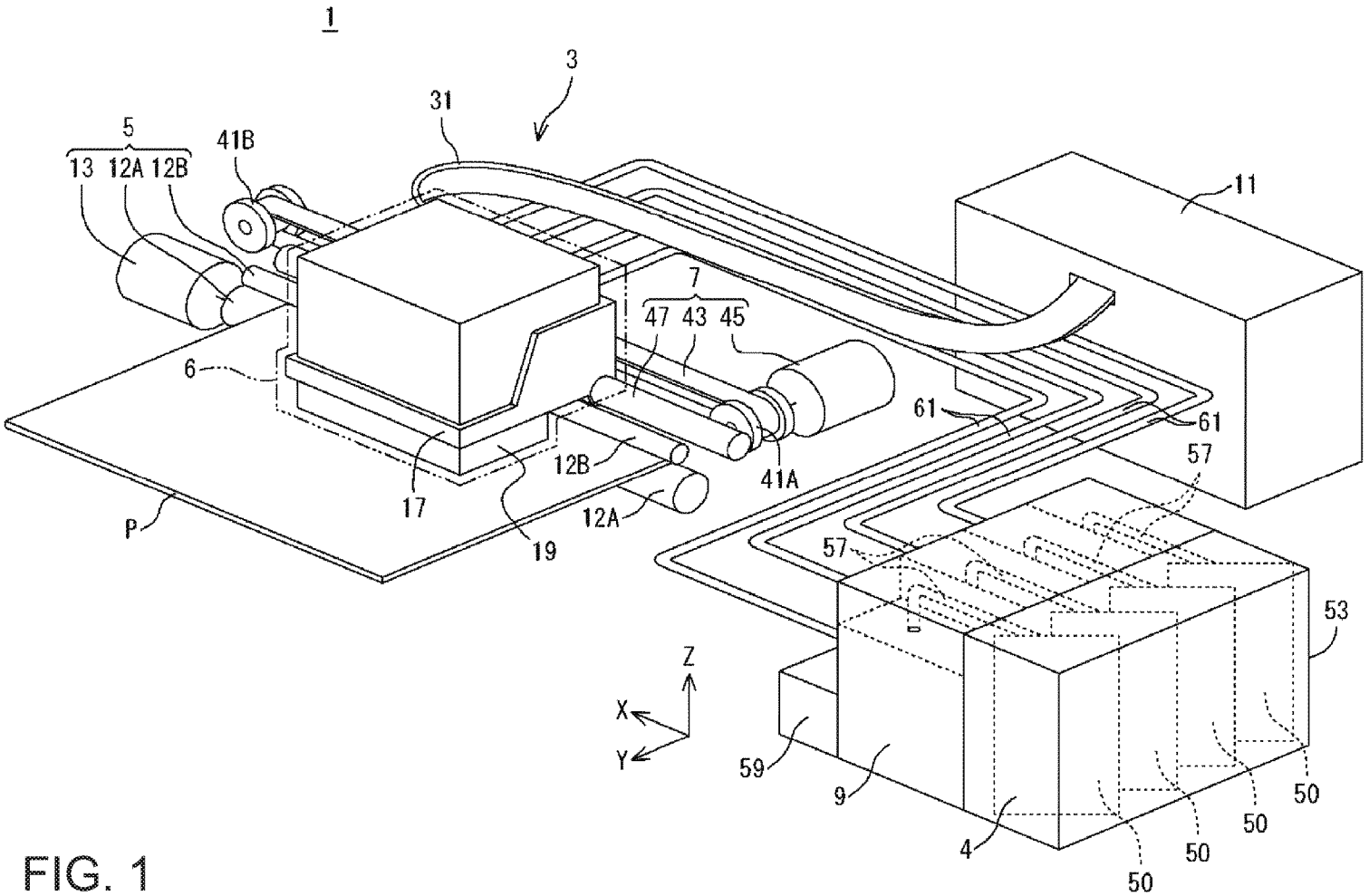
FIG. 1 is a perspective view showing a relevant configuration of a liquid ejection system according to an embodiment.

Embodiments will be described taking a liquid ejection system as an example, with reference given to the drawings. Note that in the drawings, the scales of the configurations and members are changed so as to be of a size at which the configurations are visible.

As shown in FIG. 1, a liquid ejection system 1 according to the present embodiment includes a printer 3, which is an example of a liquid ejection apparatus, and an ink supply apparatus 4, which is an example of a liquid supply apparatus. The printer 3 includes a conveying device 5, a recording unit 6, a moving device 7, a relay device 9, and a control unit 11. Note that X, Y, and Z axes, which are coordinate axes that are orthogonal to each other, are included in FIG. 1. The drawings shown hereinafter also include the X, Y, and Z axes as necessary. In the present embodiment, a state in which the liquid ejection system 1 is arranged on a horizontal plane defined by the X axis and the Y axis (XY plane) is the use state of the liquid ejection system 1. The Z axis is an axis that is orthogonal to the horizontal plane. In the use state of the liquid ejection system 1, the Z axis direction is the vertically upward direction. Also, in the use state of the liquid ejection system 1, in FIG. 1, the −Z axis direction is the vertically downward direction. Note that the directions of the arrows on the X, Y, and Z axes indicate + (positive) directions, and the directions opposite to the directions of the arrows indicate − (negative) directions.

The conveying device 5 conveys recording media P such as recording sheets intermittently in the Y direction. The recording unit 6 performs recording with ink, which is an example of a liquid, on a recording medium P conveyed by the conveying device 5. The moving device 7 reciprocally moves the recording unit 6 along the X axis. The ink supply apparatus 4 supplies ink to the recording unit 6 via the relay device 9. The relay device 9 is provided between the ink supply apparatus 4 and the recording unit 6 and relays the ink from the ink supply apparatus 4 to the recording unit 6. The control unit 11 controls the driving of the above-described configurations.

As shown in FIG. 1, the conveying device 5 includes a driving roller 12A, a driven roller 12B, and a conveying motor 13. The driving roller 12A and the driven roller 12B are configured to be able to rotate by coming into contact with each other at their outer circumferences. The conveying motor 13 generates power for driving the driving roller 12A so as to rotate. The power from the conveying motor 13 is transmitted to the driving roller 12A via a transmission mechanism. Also, recording media P that are sandwiched between the driving roller 12A and the driven roller 12B are conveyed intermittently in the Y direction.

The recording unit 6 includes a carriage 17 and a recording head 19. The recording head 19 is an example of a liquid ejection unit, and performs recording on a recording medium P by discharging ink as ink droplets. The recording head 19 is mounted on the carriage 17. Note that the recording head 19 is connected to the control unit 11 via a flexible cable 31. The discharge of ink droplets from the recording head 19 is controlled by the control unit 11.

As shown in FIG. 1, the moving device 7 includes a timing belt 43, a carriage motor 45, and a guide shaft 47. The timing belt 43 is provided stretched between a pulley 41A and a pulley 41B, which constitute a pair. The pulley 41A and the pulley 41B, which constitute the pair, are aligned along the X axis. For this reason, the timing belt 43 is provided stretched along the X axis. The carriage motor 45 generates power for driving the pulley 41A so as to rotate. The guide shaft 47 extends along the X axis. The two ends of the guide shaft 47 are supported by a housing (not shown), and the guide shaft 47 guides the carriage 17 along the X axis.

The carriage 17 is fixed to a portion of the timing belt 43. Power is transmitted from the carriage motor 45 to the carriage 17 via the pulley 41A and the timing belt 43. Also, the carriage 17 is configured to be able to move reciprocally along the X axis due to the power transmitted thereto.

As shown in FIG. 1, ink supply sets 50, which are examples of liquid supply sets, are mounted detachably in the ink supply apparatus 4. Also, the ink supply apparatus 4 has a case 53, which is an example of a cover. Note that in the present embodiment, multiple (in the present embodiment, four) ink supply sets 50 can be mounted in the ink supply apparatus 4. The four ink supply sets 50 are contained in the case 53. Accordingly, the ink supply sets 50 can be covered by the case 53. For this reason, the ink supply sets 50 can be protected by the case 53, and therefore it is easy to avoid a case in which dust and the like attaches to the ink supply sets 50 and a case in which the ink supply sets 50 are damaged, for example.

A mounting/dismounting unit (to be described later) that supports the ink supply sets 50 is provided in the case 53. The four ink supply sets 50 are supported detachably on the mounting/dismounting unit. The ink supply sets 50 include ink containing portions, which are examples of liquid containing portions. Ink is hermetically sealed in the ink containing portions, which are constituted by flexible sheets. With the liquid ejection system 1, when the ink in an ink containing portion is consumed, that ink supply set 50 is replaced with a new ink supply set 50.

Ink supply tubes 57 are connected to the ink containing portions of the ink supply sets 50 via the mounting/dismounting unit (not shown). The ink supply tubes 57, which are examples of flow path members, are connected from the ink supply apparatus 4 to the relay device 9. The relay device 9 has a pump unit 59, which is an example of a pump. The pump unit 59 draws up the ink in the ink containing portions of the ink supply sets 50 mounted in the ink supply apparatus 4. Also, the pump unit 59 transmits the ink drawn up from the ink containing portions of the ink supply sets 50 to the recording head 19 via ink supply tubes 61. Accordingly, the supply of ink from the ink supply apparatus 4 to the recording head 19 can be assisted by the pump unit 59. Thus, the ink in the ink containing portions of the ink supply sets 50 is supplied from the ink supply apparatus 4 to the recording head 19 via the relay device 9. Also, the ink supplied to the recording head 19 is discharged as ink droplets from a nozzle (not shown) directed to the recording medium P. Note that in the above-described example, the relay device 9 and the ink supply apparatus 4 were described as separate configurations, but it is also possible to include the relay device 9 in the configuration of the ink supply apparatus 4. It is also possible to include the relay device 9 in the configuration of the printer 3.

In the liquid ejection system 1 having the above-described configuration, the driving of the conveying motor 13 is controlled by the control unit 11 and the conveying device 5 causes recording media P to oppose the recording head 19 while intermittently conveying recording media P in the Y axis direction. At this time, the control unit 11 controls the driving of the carriage motor 45 to cause the carriage 17 to move reciprocally along the X axis, while controlling the driving of the recording head 19 to cause ink droplets to be discharged at predetermined positions. With this kind of operation, dots are formed on the recording medium P, and recording based on recorded information such as image data is performed on the recording medium P.

Various working examples of the ink supply sets 50 will be described. Note that in the description below, in order to identify the ink supply sets 50 in each working example, different letters for each working example are added to the reference numerals of the ink supply sets 50.

Working Example 1

Figure 2:
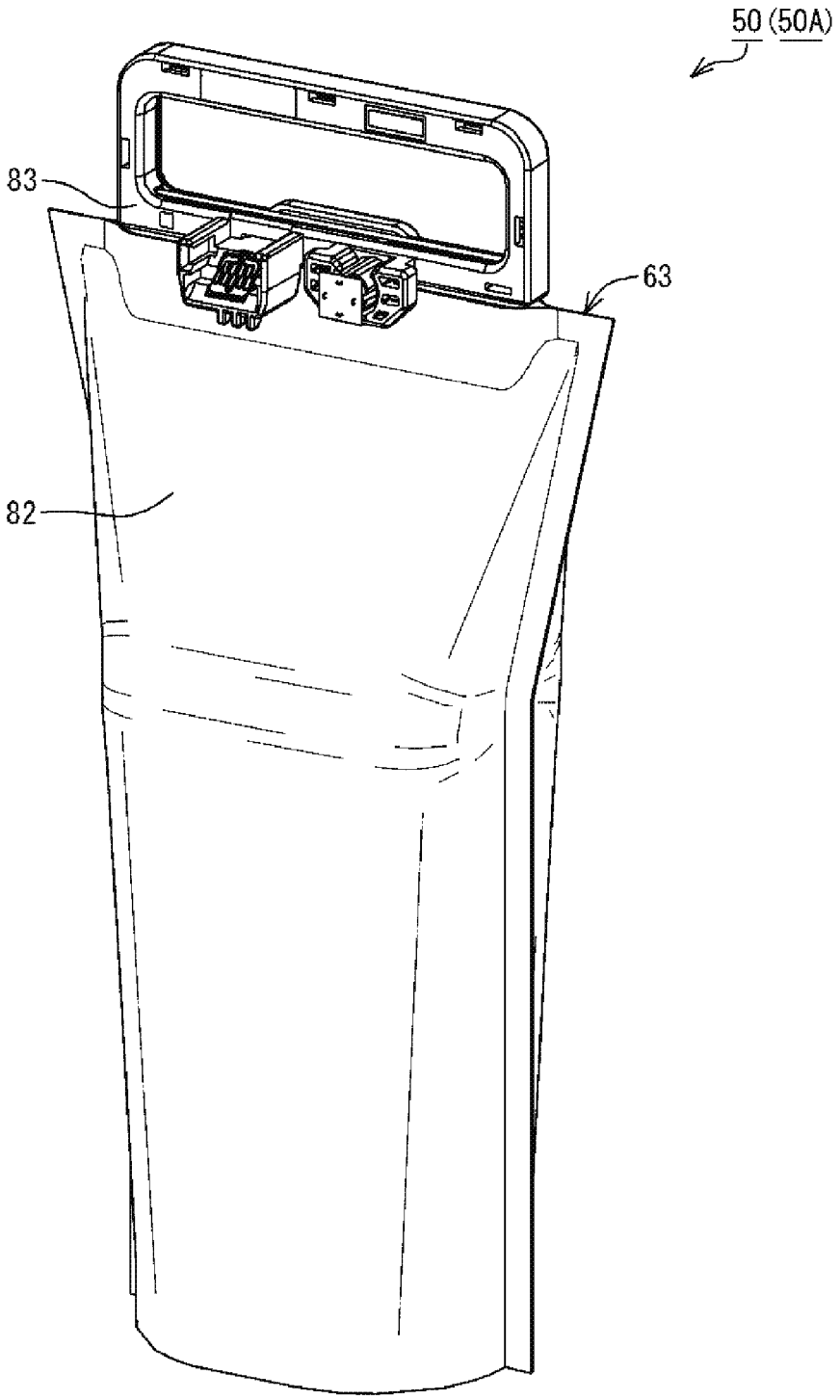
FIG. 2 is a perspective view showing an ink supply set according to Working Example 1.
Figure 3:
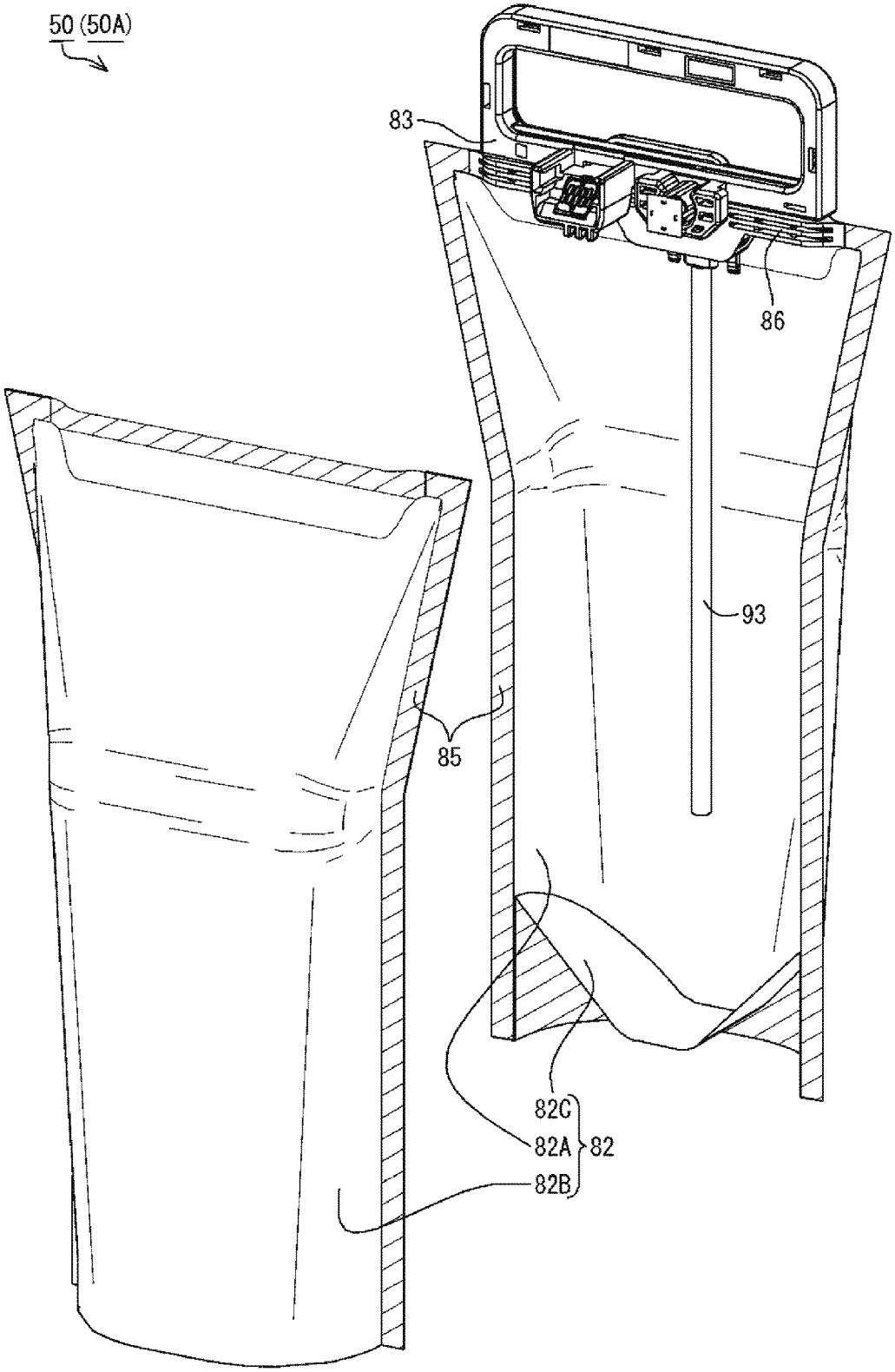
FIG. 3 is an exploded perspective view showing an ink containing body according to Working Example 1.

As shown in FIG. 2, an ink supply set 50A according to Working Example 1 includes an ink containing body 63, which is an example of a liquid containing body. The ink containing body 63 includes an ink containing portion 82, which is an example of a liquid containing portion, and a connection unit 83. As shown in FIG. 3, the ink containing portion 82 includes a flexible film material 82A, a flexible film material 82B, and a flexible film material 82C. The film material 82A and the film material 82B are welded together at a circumferential edge region 85 while overlapping each other. The film material 82C is sandwiched by the film material 82A and the film material 82B. The circumferential edge of the film material 82C is welded to the film material 82A and the film material 82B while overlapping the circumferential edge region 85.

Accordingly, the ink containing portion 82 has a mode in the form of a bag in which the film material 82C is used as the bottom portion. Ink is contained inside of the ink containing portion 82. For this reason, the ink containing portion 82 functions as an ink containing portion that contains ink, which is an example of a liquid. Also, because at least part of the ink containing portion 82 is flexible, it is possible to reduce a drop in pressure in the ink containing portion 82 that occurs when the ink in the ink containing portion 82 is consumed. Note that in FIG. 3, the circumferential edge region 85 is hatched in order to show the configuration in a manner that is easy to understand. Also, FIG. 3 shows a state in which the film material 82C has been cut between the film material 82A and the film material 82B.

For example, polyethylene terephthalate (PET), nylon, polyethylene, and the like can be used as the materials of the film material 82A, the film material 82B, and the film material 82C. Also, a stacked structure obtained by stacking films constituted by these materials can be used. With this kind of stacked structure, for example, the outer layer can be made of PET or nylon, which has excellent shock resistance, and the inner layer can be made of polyethylene, which has excellent ink resistance. Furthermore, a film or the like having a layer obtained by vapor-depositing aluminum or the like can also be used. Accordingly, a gas barrier property can be increased.

The connection unit 83 is sandwiched by the film material 82A and the film material 82B at a portion of the circumferential edge region 85. At a portion of the circumferential edge region 85, the connection unit 83 and the film material 82A are welded together. Similarly, at a portion of the circumferential edge region 85, the connection unit 83 and the film material 82B are welded together. For this reason, the portion of the circumferential edge region 85 at which the connection unit 83 is sandwiched by the film material 82A and the film material 82B is the portion at which the ink containing portion 82 and the connection unit 83 are joined. The connection unit 83 is provided with a welded portion 86. The film material 82A and the film material 82B are welded at the welded portion 86 while the welded portion 86 is sandwiched by the film material 82A and the film material 82B. Due to the film material 82A, the film material 82B, and the connection unit 83 being joined to each other, the ink containing portion 82, whose bottom portion is formed by the film material 82C, is formed.

Figure 4:
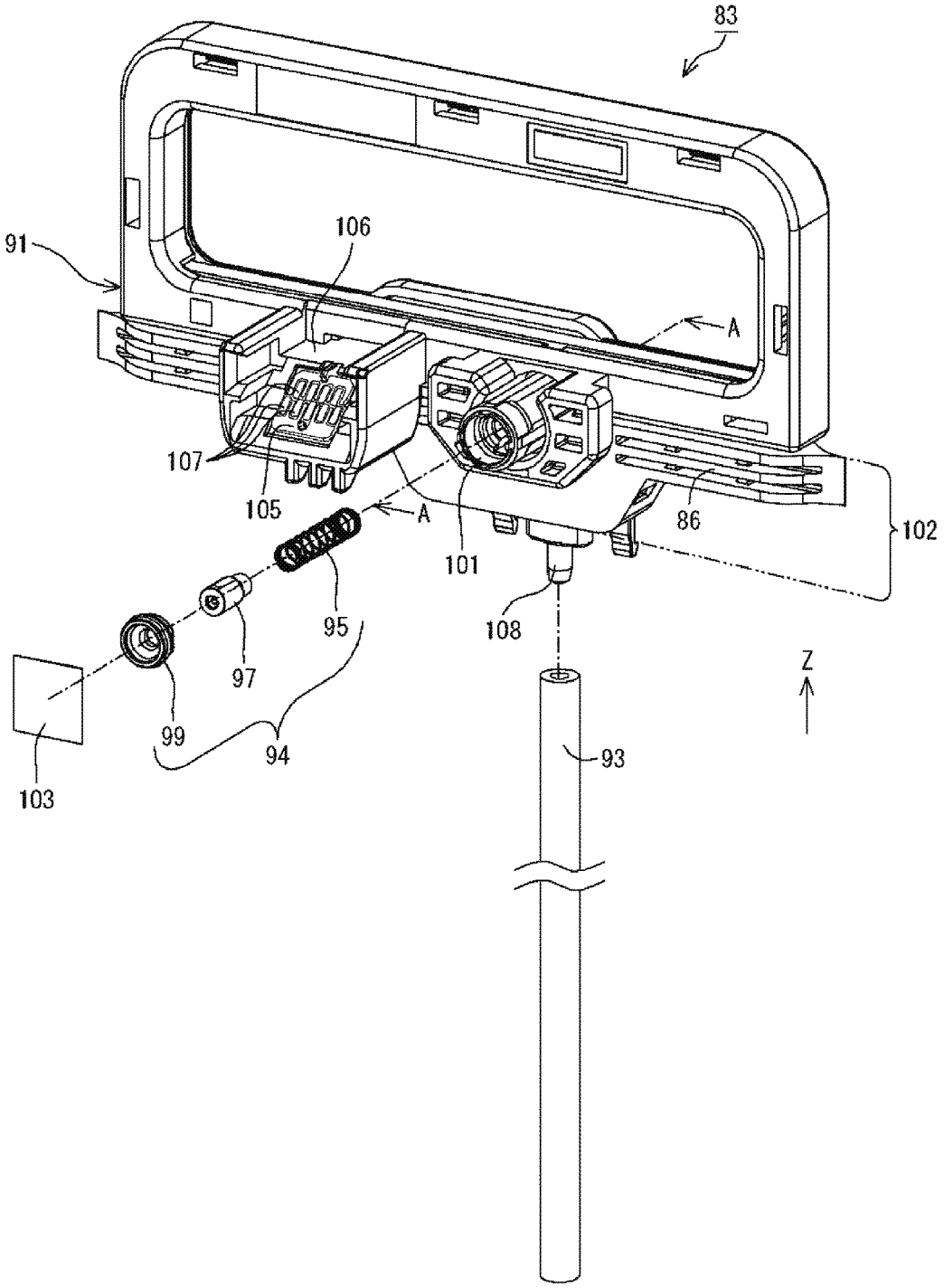
FIG. 4 is an exploded perspective view showing a connection unit according to Working Example 1.

As shown in FIG. 4, the connection unit 83 includes a connection member 91, a tube 93, and a valve unit 94. The valve unit 94 includes a spring 95, a plug (valve body) 97, and a gasket (valve seat) 99. The connection member 91 is provided with an ink guiding portion 101, which is an example of a liquid exit portion. The connection member 91 is located at an end portion of the ink containing portion 82. The connection member 91 has a base portion 102. The ink guiding portion 101 is provided on the base portion 102. The ink guiding portion 101 protrudes from the base portion 102 in a direction that intersects the Z axis. The inner portion and the outer portion of the ink containing portion 82 (FIG. 3) are in communication via the ink guiding portion 101. The connection member 91 protrudes outward with respect to the ink containing portion 82. The connection member 91 functions as a liquid guiding portion that guides the ink, which is an example of a liquid, from the inner portion to the outer portion of the ink containing portion 82. The spring 95, the plug 97, and the gasket 99 are contained in the ink guiding portion 101 in the stated order. The ink guiding portion 101 is closed by the film 103 in the state in which the ink containing body 63 has not yet been mounted in the ink supply apparatus 4. Accordingly, the inner portion of the ink containing portion 82 is kept in the hermetically-sealed state.

Also, the connection unit 83 is provided with a circuit board 105, which is an example of an electrical contact portion. The connection member 91 is provided with a substrate installation portion 106, which is an example of a holding portion. The substrate installation portion 106 is provided on the base portion 102. The substrate installation portion 106 protrudes from the base portion 102 in a direction that intersects the Z axis. The substrate installation portion 106 is provided on the ink guiding portion 101 side of the connection member 91. That is, the ink guiding portion 101 and the substrate installation portion 106 are provided on the same side of the connection member 91. The circuit board 105 is provided on the substrate installation portion 106. The circuit board 105 is provided with multiple terminal portions 107. The multiple terminal portions 107 face the side opposite to the connection member 91 side of the circuit board 105. A storage device (not shown) such as a non-volatile memory is provided on the side opposite to the terminal portion 107 side of the circuit board 105. At least a portion of the multiple terminal portions 107 are electrically connected to the storage device.

In the connection member 91, the side surface of the base portion 102 is set as the welded portion 86. The connection member 91 is provided with an introduction port 108, which is an example of a flow path connection portion. The introduction port 108 is provided on the base portion 102 and extends along the Z axis. The introduction port 108 extends from the base portion 102 in the −Z axis direction. The introduction port 108 is in communication with the interior of the ink containing portion 82 and introduces the ink in the ink containing portion 82 to the ink guiding portion 101. The introduction port 108 is in communication with the ink guiding portion 101. Note that the ink guiding portion 101 extends in a direction that intersects the extension direction of the introduction port 108, or in other words, in a direction that intersects the Z axis. The tube 93 is connected to the introduction port 108. Also, as shown in FIG. 3, the tube 93 is contained in the ink containing portion 82. An introduction path to the introduction port 108 is extended into the ink containing portion 82 by the tube 93.

Figure 5:
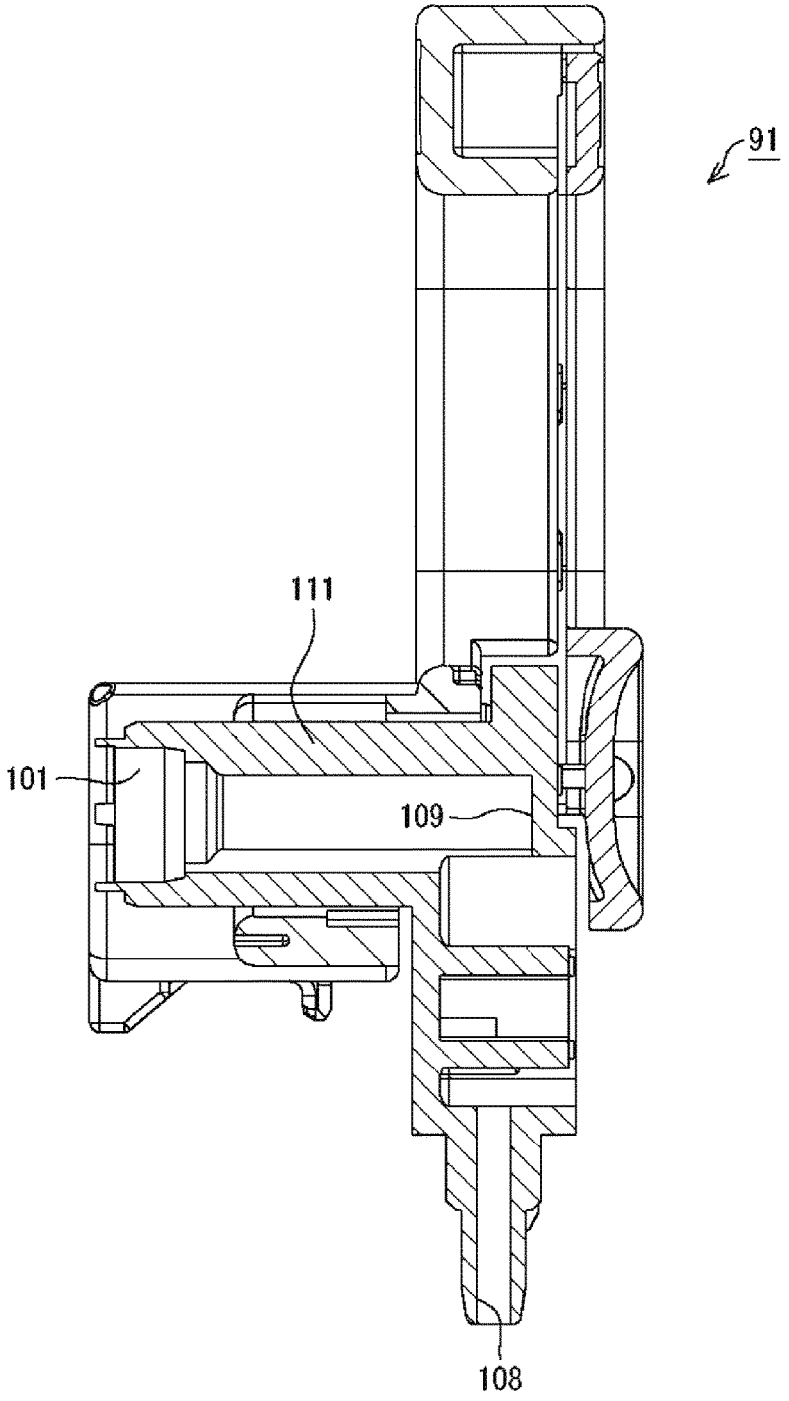
FIG. 5 is a cross-sectional view of a connection member according to Working Example 1, taken along line A-A in FIG. 4.
Figure 6:
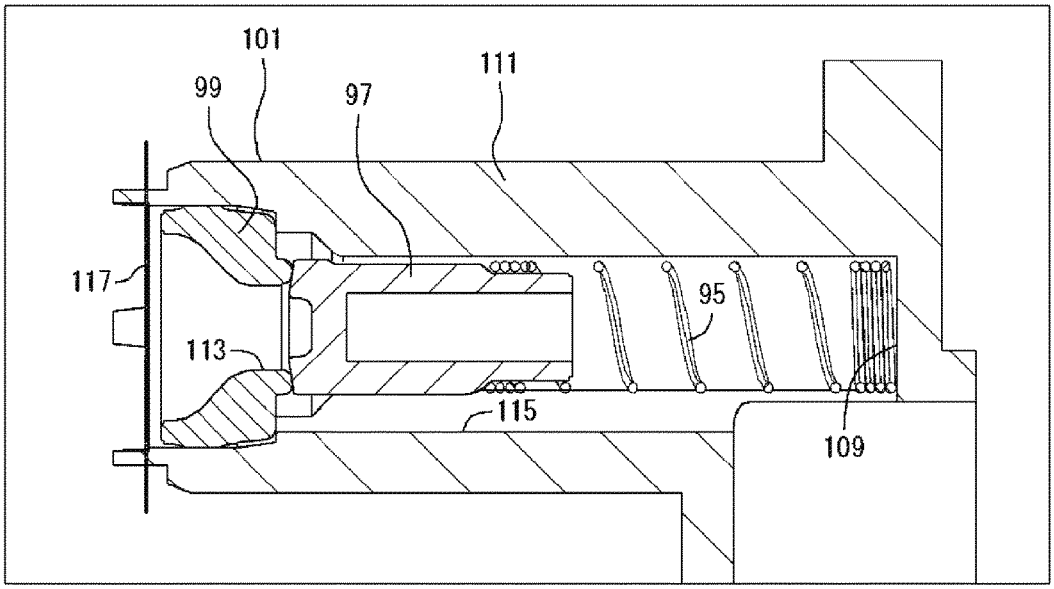
FIG. 6 is an enlarged cross-sectional view of the connection unit according to Working Example 1, taken along line A-A in FIG. 4.

As shown in FIG. 5, which is a cross-sectional view obtained by cutting the connection member 91 along line A-A in FIG. 4, the ink guiding portion 101 is in communication with the introduction port 108 inside of the connection member 91. The ink guiding portion 101 has a bottom portion 109 and a side wall 111. The side wall 111 surrounds the bottom portion 109. The region surrounded by the side wall 111 functions as a supply port that supplies the ink in the ink containing portion 82 to the outer portion. As shown in FIG. 6, the spring 95, the plug 97, and the gasket 99 are contained inside of the ink guiding portion 101. The spring 95 is sandwiched by the bottom portion 109 of the ink guiding portion 101 and the plug 97. The plug 97 is sandwiched by the spring 95 and the gasket 99. For this reason, the plug 97 is biased toward the gasket 99 by the spring 95.

For example, the gasket 99 is constituted by an elastic member made of rubber, elastomer, or the like. The gasket 99 is pressed into the ink guiding portion 101. The gasket 99 is provided with an opening portion 113. The plug 97 is biased toward the gasket 99 while overlapping with the opening portion 113 of the gasket 99. For this reason, the opening portion 113 of the gasket 99 is closed by the plug 97. A gap is maintained between the plug 97 and the ink guiding portion 101. Also, a gap is maintained between the spring 95 and the ink guiding portion 101 as well. For this reason, the plug 97 and the spring 95 can be displaced in the inner portion of the ink guiding portion 101 in the extension direction of the ink guiding portion 101.

Here, a groove 115 is provided inside of the ink guiding portion 101. The groove 115 extends from the terminal edge 117 side of the ink guiding portion 101 toward the bottom portion 109 along the extension direction of the ink guiding portion 101. The groove 115 extends past the spring 95 from the bottom portion 109 to the gasket 99 side. The groove 115 is provided in an orientation of being recessed from the inner wall to the outer wall of the ink guiding portion 101. For this reason, it is possible to use the space surrounded by the plug 97 and the groove 115 as a flow path for ink when the plug 97 is contained in the ink guiding portion 101.

Figure 7:
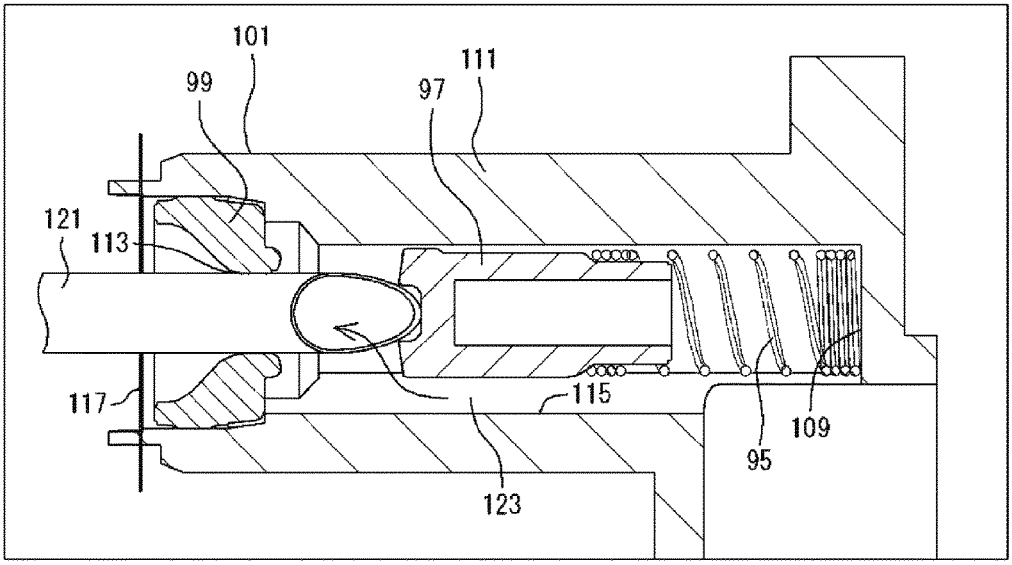
FIG. 7 is an enlarged cross-sectional view of the connection unit according to Working Example 1, taken along line A-A in FIG. 4.

When the ink containing body 63 is mounted in the ink supply apparatus 4 (FIG. 1), as shown in FIG. 7, a supply needle 121 is inserted into the opening portion 113 of the gasket 99. At this time, the plug 97 is pressed by the supply needle 121 and is displaced toward the bottom portion 109. The supply needle 121 is formed so as to be hollow. Also, the supply needle 121 is in communication with an ink supply tube 57. Accordingly, as indicated by the arrow in the diagram, the ink can be supplied from a flow path 123 surrounded by the groove 115 and the plug 97 to the ink supply tube 57 (FIG. 1) via the supply needle 121. Note that the supply needle 121 is provided in the case 53 of the ink supply apparatus 4.

Figure 8:
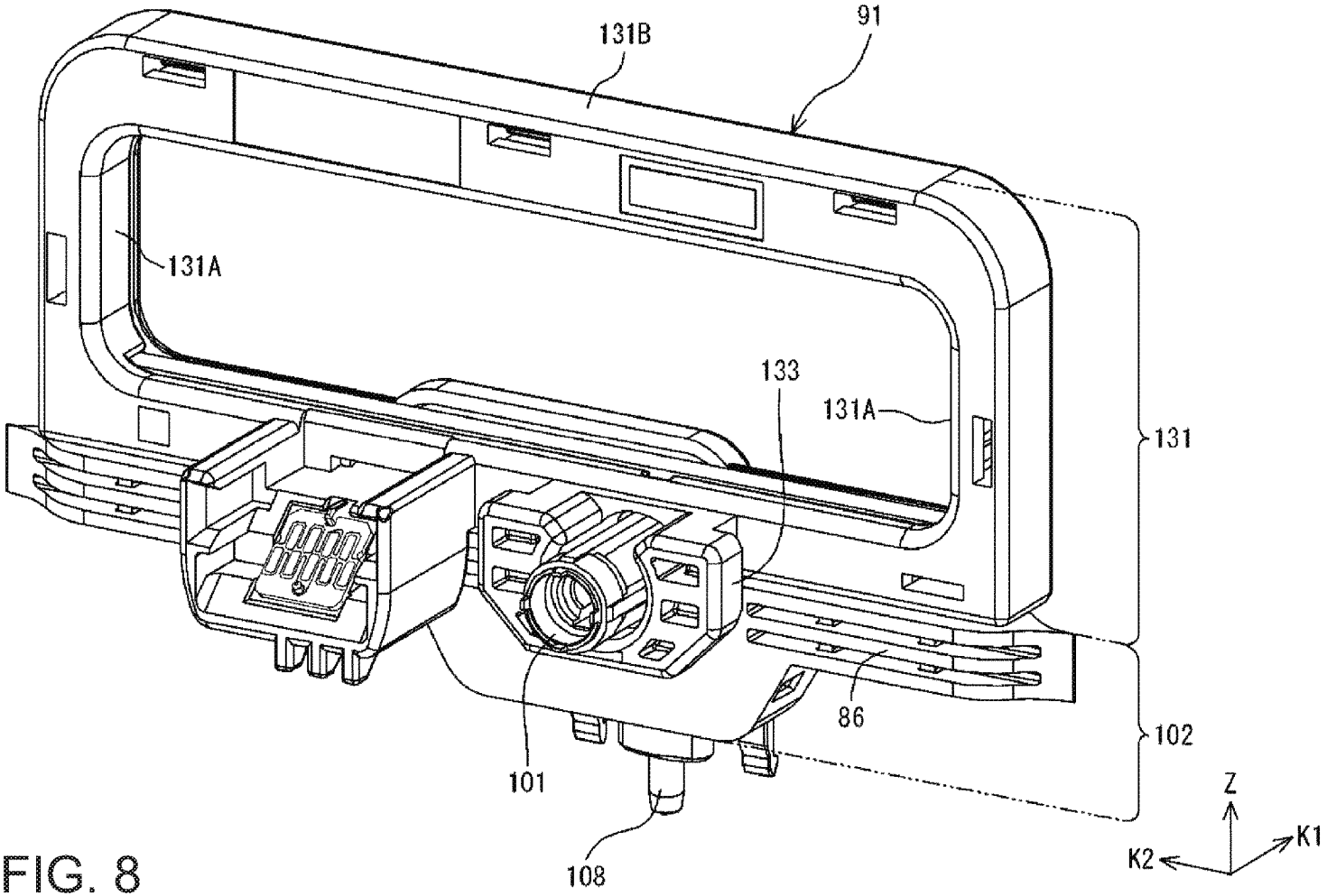
FIG. 8 is an exploded perspective view showing the connection member according to Working Example 1.

As shown in FIG. 8, the connection member 91 has a handle portion 131. The handle portion 131 is provided on the base portion 102. The handle portion 131 protrudes from the base portion 102 in the Z axis positive direction, or in other words, protrudes from the base portion 102 toward a side opposite to the introduction port 108 side, that is, the ink containing portion 82 side, of the base portion 102. For this reason, the handle portion 131 protrudes from the ink containing portion 82, outward of the ink containing portion 82. The handle portion 131 extends along the extension direction of the base portion 102. The handle portion 131 has two leg portions 131A and a gripping portion 131B. The two leg portions 131A are provided on the base portion 102 and extend from the base portion 102 in the Z axis positive direction. The two leg portions 131A are both connected to the base portion 102, and therefore are also referred to as connection sites.

The two leg portions 131A are separate from each other in the extension direction of the base portion 102. The gripping portion 131B is provided on the Z axis positive direction side with respect to the two leg portions 131A, or in other words, on the side opposite to the base portion 102 side with respect to the two leg portions 131A. The gripping portion 131B extends in the extension direction of the base portion 102. The two leg portions 131A are both connected to the gripping portion 131B. With the above-described configuration, a worker can insert his or her fingers between the gripping portion 131B and the base portion 102 and grip the gripping portion 131B. Also, the worker can hold the ink containing body 63 while gripping the gripping portion 131B.

Also, as shown in FIG. 8, the connection member 91 has an engaging portion 133. The engaging portion 133 has a flat exterior, and intersects the ink guiding portion 101. The engaging portion 133 bulges outward of the ink guiding portion 101. For this reason, the engaging portion 133 has a flange shape that bulges outward of the ink guiding portion 101. The engaging portion 133 bulges outward from the ink guiding portion 101 with respect to the ink guiding portion 101. That is, the engaging portion 133 includes sites that bulge toward the two leg portions 131A with respect to the ink guiding portion 101, and a site that bulges toward the side opposite to the gripping portion 131B side, or in other words, the −Z axis direction side, with respect to the ink guiding portion 101. The engaging portion 133 is separated from the base portion 102. That is, there is a gap between the engaging portion 133 and the base portion 102.

Figure 9:
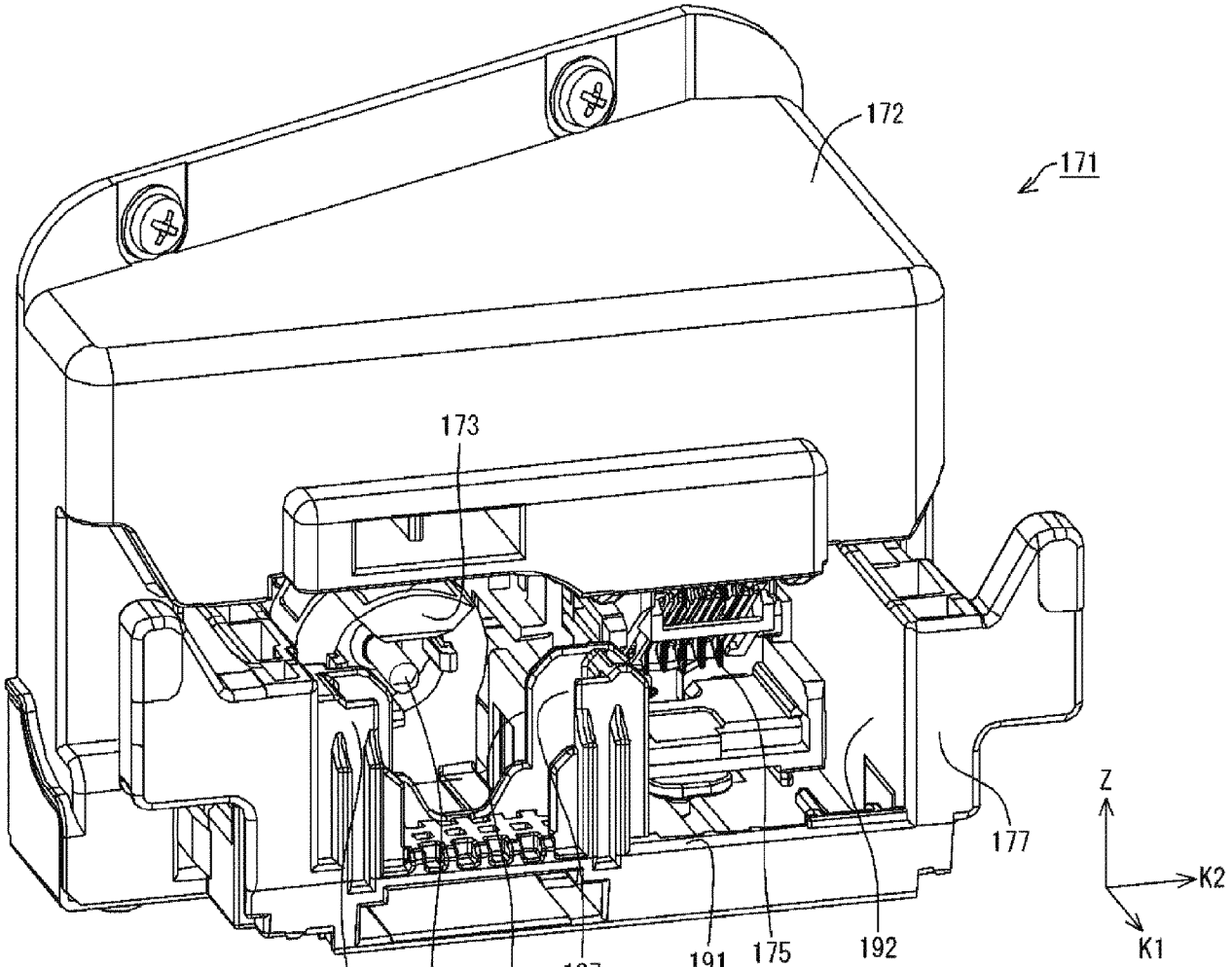
FIG. 9 is a perspective view showing a mounting/dismounting unit according to an embodiment.

The mounting/dismounting unit 171 provided in the ink supply apparatus 4 will be described next. The mounting/dismounting unit 171 includes a mechanism for mounting/dismounting the ink supply set 50 on/from the ink supply apparatus 4. With the ink supply set 50A according to Working Example 1, the mounting/dismounting unit 171 detachably supports the ink containing body 63. The number of mounting/dismounting units 171 provided in the ink supply apparatus 4 is the same as the number of ink supply sets 50 that can be mounted in the ink supply apparatus 4. That is, a mounting/dismounting unit 171 is provided for each ink supply set 50 that is mounted in the ink supply apparatus 4. As shown in FIG. 9, the mounting/dismounting unit 171 has a holder 172, an ink introduction portion 173, which is an example of a liquid introduction portion, a contact point mechanism 175, which is an example of an electrical contact portion, and a movable member 177, which is an example of a movable support portion. The holder 172 is a member that supports the mounting/dismounting unit 171. The ink introduction portion 173 and the contact point mechanism 175 are provided in the holder 172. As a fixed mode of the holder 172, it is possible to use a mode of being fixed directly to the printer 3, or a mode of being fixed to the printer 3 via the case 53 of the ink supply apparatus 4.

The ink introduction portion 173 has the above-described supply needle 121. The ink introduction portion 173 functions as a liquid introduction portion that introduces ink guided from the ink containing portion 82 of the ink containing body 63 to the relay device 9 via the ink guiding portion 101. Also, the supply needle 121 is in communication with the ink supply tube 57. Here, in the ink supply apparatus 4, the direction in which the supply needle 121 extends is the K1 direction. The Z axis direction of the ink supply apparatus 4 is the same as the Z axis direction of the liquid ejection system 1. Also, the direction intersecting both the K1 direction and the Z axis direction is the K2 direction. According to this definition, in the ink supply apparatus 4, with the connection member 91 of the ink containing body 63, the ink guiding portion 101 extends in the K1 direction and the base portion 102 extends in the K2 direction, as shown in FIG. 8. Similarly, the gripping portion 131B also extends in the K2 direction.

The contact point mechanism 175 (FIG. 9) is a connection portion that is electrically connected to the circuit board 105 of the ink containing body 63. When the ink containing body 63 is mounted on the mounting/dismounting unit 171, at least a portion of the multiple terminal portions 107 (FIG. 4) of the circuit board 105 come into contact with the contact point mechanism 175. The contact point mechanism 175 is electrically connected to the control unit 11 via the flexible cable 31 (FIG. 1). Also, the contact point mechanism 175 and the storage device (not shown) of the ink containing body 63 are electrically connected via the circuit board 105, whereby various types of information can be transmitted between the control unit 11 and the storage device of the ink containing body 63.

The movable member 177 is configured to be able to extend and retract in the K1 direction with respect to the holder 172. In a view of the mounting/dismounting unit 171 from the K1 direction, the movable member 177 is provided at a position that overlaps with the ink introduction portion 173, and spans across a region extending across the ink introduction portion 173 and the contact point mechanism 175 in the K2 direction. The movable member 177 is provided with a support portion 183. In a view of the mounting/dismounting unit 171 from the K1 direction, the support portion 183 is provided at a position that overlaps with the ink introduction portion 173. The support portion 183 is provided with a cut-out portion 185 at a site that overlaps with the supply needle 121. For this reason, when the movable member 177 is moved in the direction opposite to the K1 direction toward the ink introduction portion 173, the supply needle 121 of the ink introduction portion 173 can be inserted into the cut-out portion 185 of the support portion 183.

Figure 10:
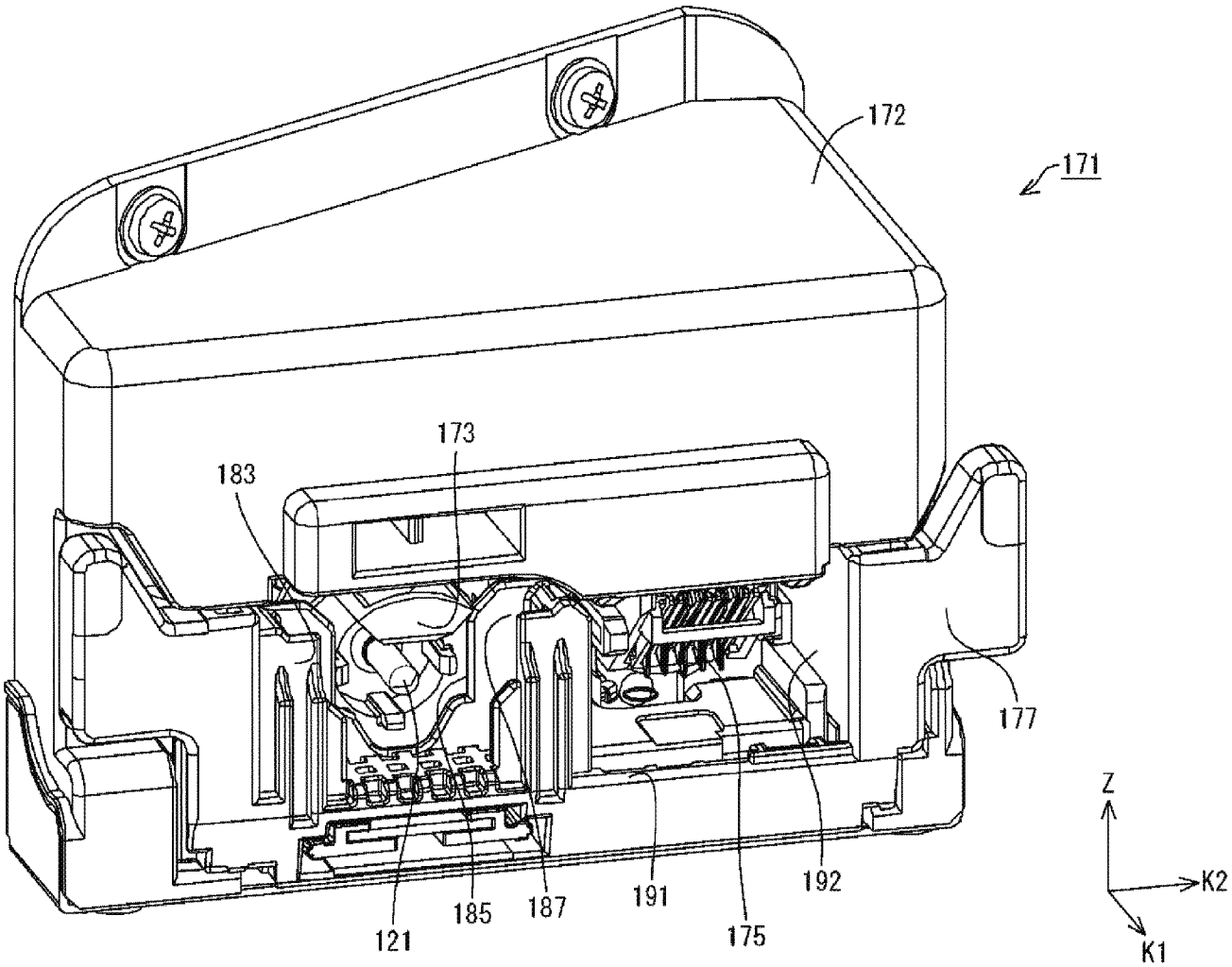
FIG. 10 is a perspective view showing the mounting/dismounting unit according to an embodiment.

The support portion 183 is provided with a recessed portion 187. In the support portion 183, the recessed portion 187 is provided in an orientation of being recessed toward the −Z axis direction. The recessed portion 187 is provided so as to span across a region straddling the cut-out portion 185 in the K2 direction. For this reason, as shown in FIG. 10, when the movable member 177 is moved toward the ink introduction portion 173 in the direction opposite to the K1 direction, the supply needle 121 can advance into the recessed portion 187 via the cut-out portion 185 of the support portion 183. The engaging portion 133 (FIG. 8) provided on the connection member 91 of the ink containing body 63 can be inserted into the recessed portion 187. When the ink guiding portion 101 of the ink containing body 63 faces the ink introduction portion 173 side of the mounting/dismounting unit 171, the engaging portion 133 of the ink containing body 63 can be inserted into the recessed portion 187 from the Z axis direction side of the recessed portion 187. Note that the engaging portion 133 is an example of a first engaging portion, and the recessed portion 187 is an example of a first engaged portion.

Also, the movable member 177 is provided with a support portion 191. In a view of the mounting/dismounting unit 171 from the K1 direction, the support portion 191 is provided at a position that overlaps with the contact point mechanism 175. The support portion 191 is provided with a cut-out portion 192 at a site that overlaps with the contact point mechanism 175. The support portion 191 is configured to be able to receive the substrate installation portion 106 of the connection unit 83 in the cut-out portion 192. The substrate installation portion 106 can engage in the −Z axis direction with the cut-out portion 192 of the support portion 191. When the engaging portion 133 of the ink containing body 63 is inserted into the support portion 183, the substrate installation portion 106 is inserted into the cut-out portion 192 of the support portion 191. Also, the support portion 191 is configured to be able to support the substrate installation portion 106 when the substrate installation portion 106 is engaged therewith. Note that the substrate installation portion 106 is an example of a second engaging portion, and the cut-out portion 192 of the support portion 191 is an example of a second engaged portion.

Here, as shown in FIG. 9, with the mounting/dismounting unit 171, the state in which the movable member 177 protrudes past the holder 172 in the K1 direction is referred to as a non-connected state. Also, the position of the movable member 177 in the non-connected state is referred to as the non-connected position. Note that in the non-connected state, the ink introduction portion 173 is located in the −K1 direction with respect to the cut-out portion 185 of the movable member 177. For this reason, in the non-connected state, the ink introduction portion 173 is separated from the ink guiding portion 101. Accordingly, the non-connected state is the state in which the ink guiding portion 101 and the ink introduction portion 173 are not connected. In the non-connected state, the mounting of the ink containing body 63 on the mounting/dismounting unit 171 is removed. For this reason, the non-connected state is also referred to as the removed state. Also, the non-connected position is also referred to as the removed position. In the removed position, the ink guiding portion 101 and the ink introduction portion 173 are separated from each other. Also, in the removed position, the contact point mechanism 175 and the terminal portions 107 of the circuit board 105 are separated from each other.

When the movable member 177 is displaced from the removed position to a connected position shown in FIG. 10, the supply needle 121 advances into the cut-out portion 185 of the movable member 177. When the supply needle 121 advances into the cut-out portion 185 of the movable member 177, the ink guiding portion 101 and the supply needle 121 are connected to each other. The state in which the ink guiding portion 101 and the supply needle 121 are connected to each other is referred to as the connected state. Also, the position of the movable member 177 in the connected state is referred to as the connected position. In the connected state, the ink guiding portion 101 and the supply needle 121 are connected to each other. Also, in the connected position, the contact point mechanism 175 and the terminal portions 107 of the circuit board 105 are in contact with each other.

Figure 11:
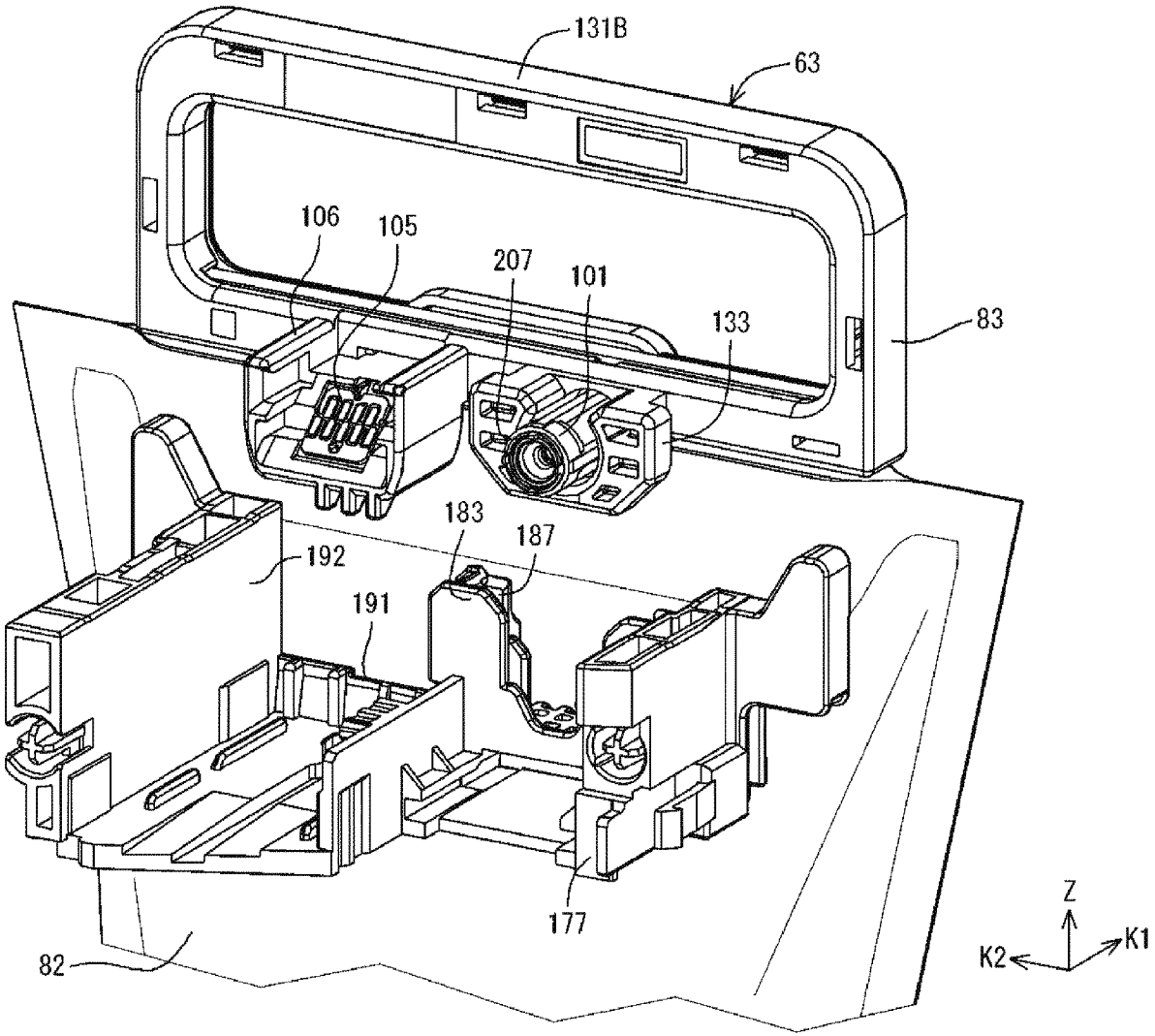
FIG. 11 is a diagram illustrating a flow of mounting the ink containing body according to Working Example 1 on the mounting/dismounting unit.

A flow of mounting the ink containing body 63 on the mounting/dismounting unit 171 (mounting method) will be described next. First, as shown in FIG. 11, when the movable member 177 is in the removed position, the engaging portion 133 of the ink containing body 63 is moved to the Z axis direction side of the recessed portion 187 of the movable member 177 while the ink guiding portion 101 of the ink containing body 63 faces the ink introduction portion 173 side of the mounting/dismounting unit 171. At this time, the substrate installation portion 106 of the connection unit 83 is face-to-face with the support portion 191 of the movable member 177 along the Z axis. At this time, the worker grips the gripping portion 131B of the ink containing body 63 to support the ink containing body 63, and thereby can easily position the engaging portion 133 on the Z axis direction side of the recessed portion 187 of the movable member 177. Note that in FIG. 11, in order to show the configuration in a manner that is easy to understand, illustration of the holder 172, ink introduction portion 173, and contact point mechanism 175 of the mounting/dismounting unit 171 is not included.

Here, when the worker grips the gripping portion 131B to support the ink containing body 63, an end surface 207 of the ink guiding portion 101 faces the −K1 direction, which intersects the Z axis direction, which is the direction in which the gripping portion 131B protrudes from the connection member 91. For this reason, when the worker grips the gripping portion 131B to support the ink containing body 63, the end surface 207 of the ink guiding portion 101 is not likely to overlap with the gripping portion 131B in the line of sight of the worker, and therefore the ink guiding portion 101 is easy to see, and mounting on the mounting/dismounting unit 171 can be performed while giving consideration to the end surface 207 of the ink guiding portion 101. Accordingly, the worker can easily position the engaging portion 133 on the Z axis direction side of the recessed portion 187 of the movable member 177.

Figure 12:
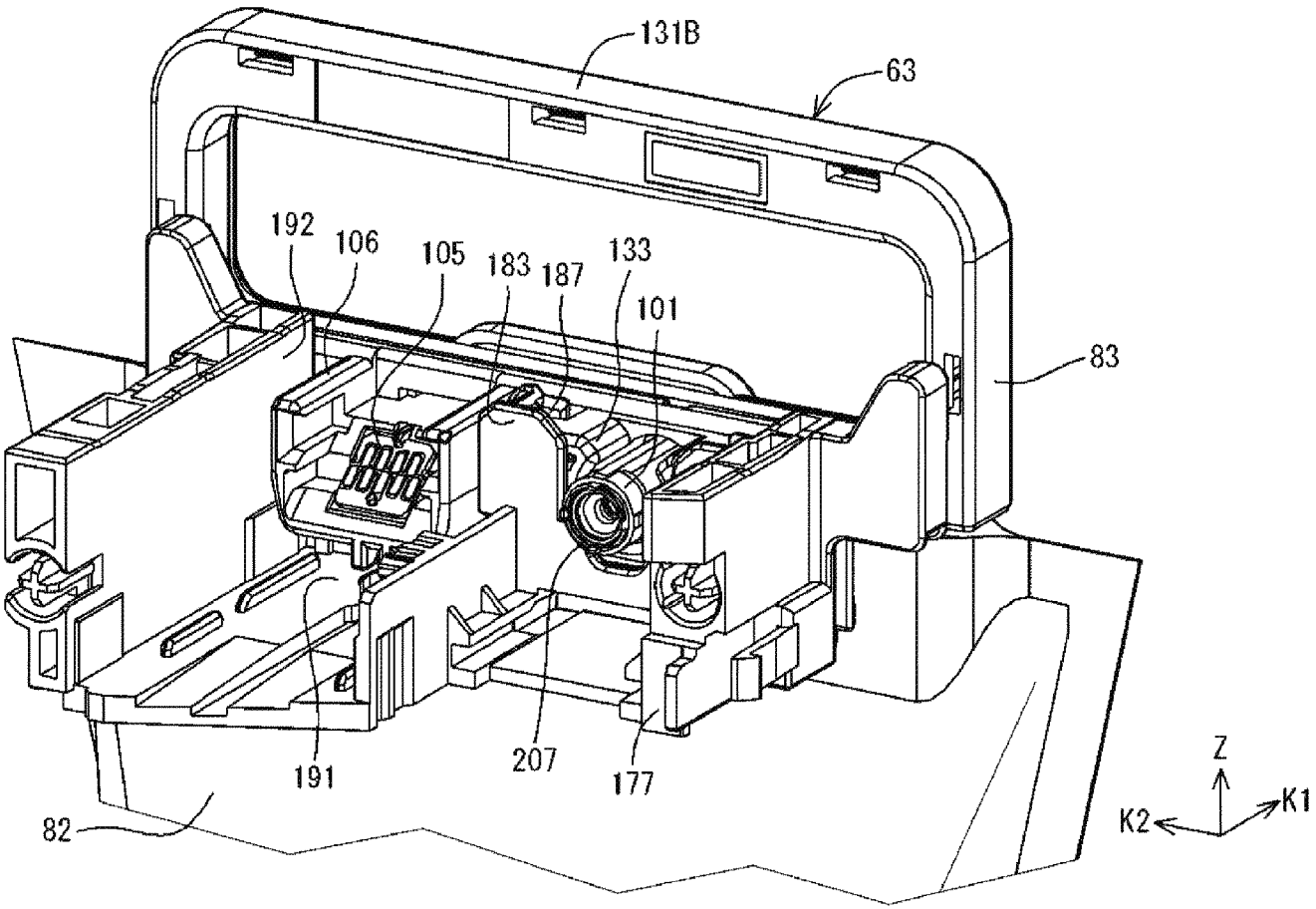
FIG. 12 is a diagram illustrating a flow of mounting the ink containing body according to Working Example 1 on the mounting/dismounting unit.

Next, as shown in FIG. 12, by lowering the ink containing body 63 in the −Z axis direction, the engaging portion 133 is engaged in the recessed portion 187 of the movable member 177. Accordingly, the ink containing portion 82 is supported by the mounting/dismounting unit 171 via the connection member 91. Accordingly, the ink containing body 63 enters a suspended state due to the engaging portion 133 being supported by the support portion 183. Thus, by causing the engaging portion 133 to engage with the recessed portion 187 of the movable member 177, the ink containing body 63 is easily mounted on and dismounted from the mounting/dismounting unit 171. Note that in FIG. 12, in order to show the configuration in a manner that is easy to understand, illustration of the holder 172, ink introduction portion 173, and contact point mechanism 175 of the mounting/dismounting unit 171 is not included.

Figure 13:
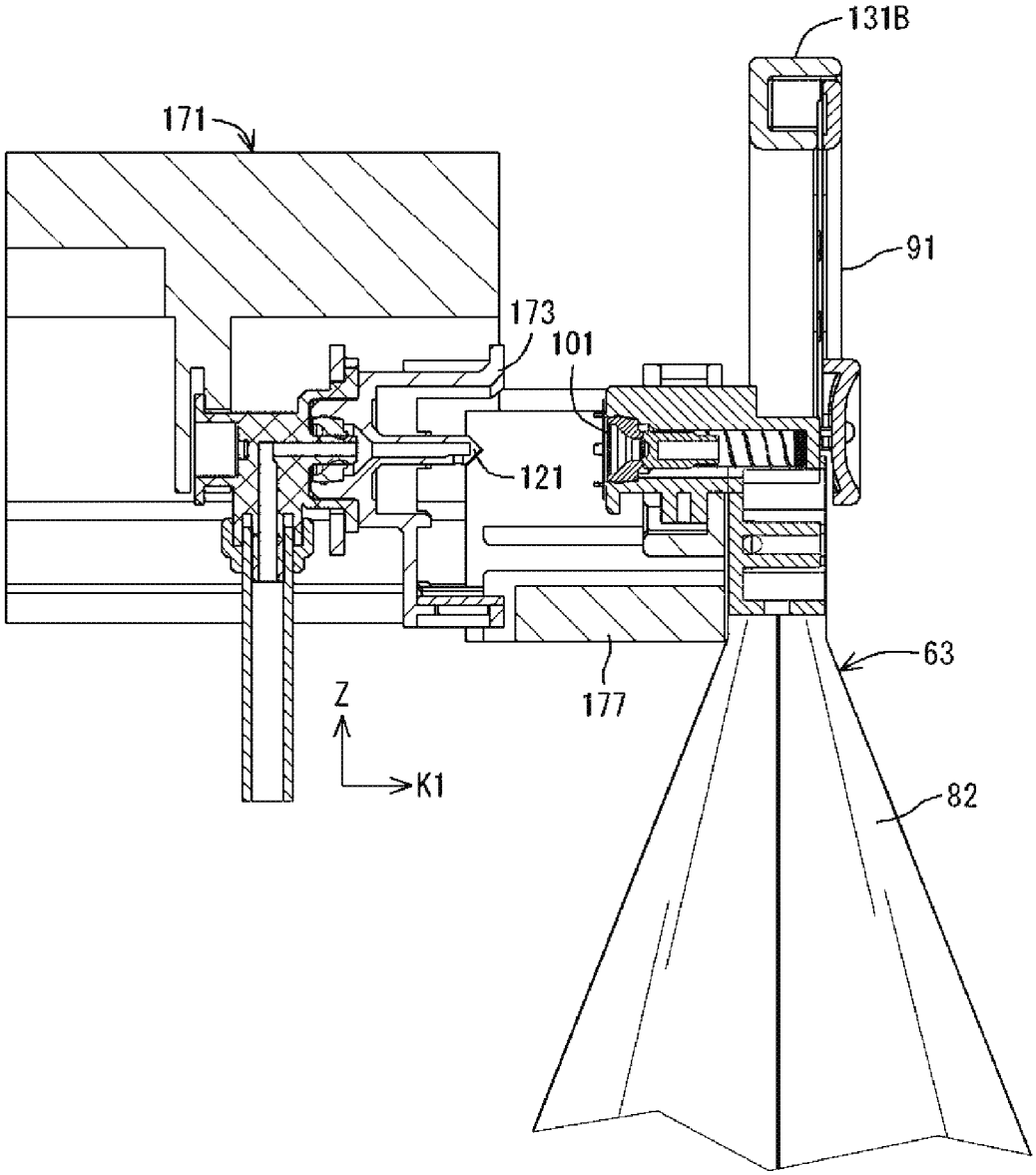
FIG. 13 is a diagram illustrating a flow of mounting the ink containing body according to Working Example 1 on the mounting/dismounting unit.

At this time, the movable member 177 is at the removed position, and therefore, as shown in FIG. 13, the ink guiding portion 101 and the ink introduction portion 173 are separated from each other. That is, in the removed position, the connection between the ink guiding portion 101 and the ink introduction portion 173 is removed. Note that FIG. 13 shows a cross-section when the mounting/dismounting unit 171 and the ink containing body 63 are cut at a position corresponding to line A-A in FIG. 4.

Figure 14:
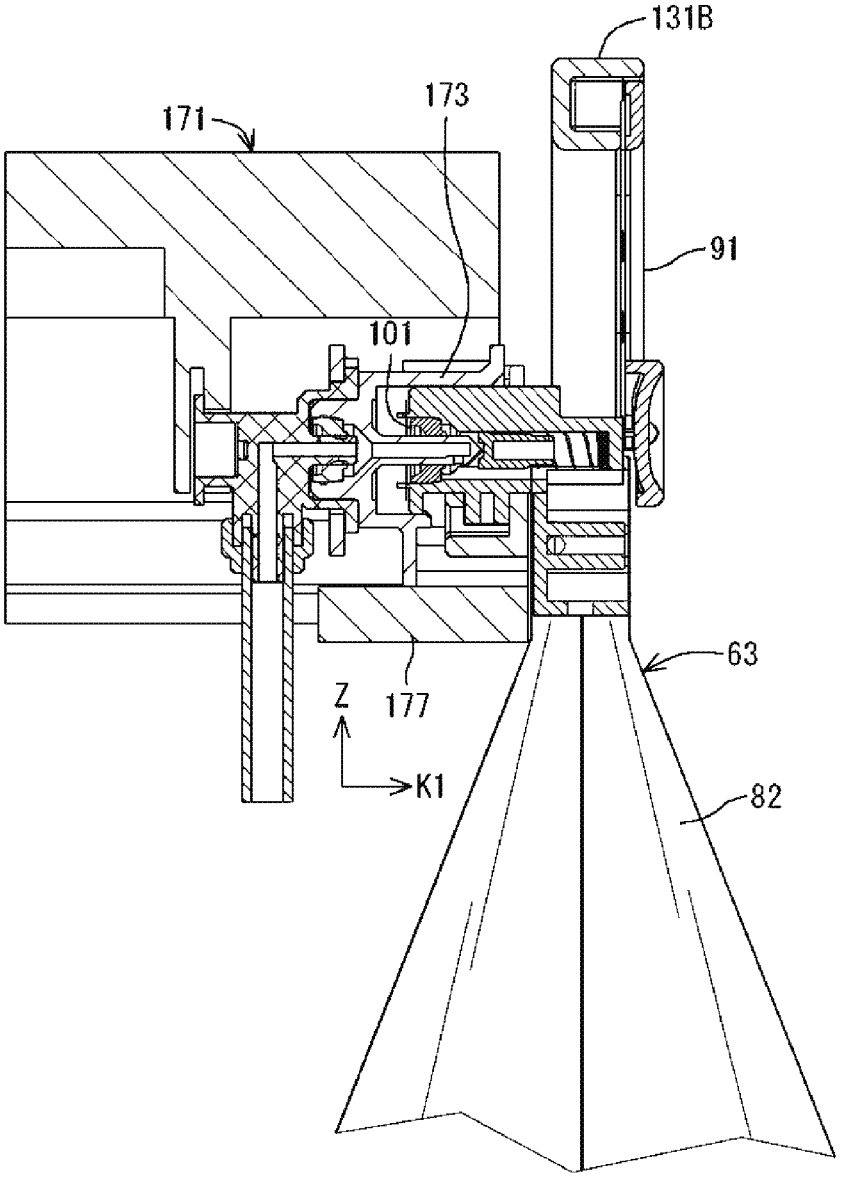
FIG. 14 is a diagram illustrating a flow of mounting the ink containing body according to Working Example 1 on the mounting/dismounting unit.

Also, as shown in FIG. 14, when the movable member 177 is displaced to the connection position, the ink guiding portion 101 can be moved in the −K1 direction. This makes it possible to connect the ink guiding portion 101 and the ink introduction portion 173, and to connect the contact point mechanism 175 and the terminal portions 107 of the circuit board 105. Note that FIG. 14 shows a cross-section when the mounting/dismounting unit 171 and the ink containing body 63 are cut at a position corresponding to line A-A in FIG. 4. Note that it is sufficient to carry out the opposite procedure of the above-described mounting method when the ink supply set 50A is to be removed from the ink supply apparatus 4. That is, when the ink supply set 50A is to be removed from the ink supply apparatus 4, first, the movable member 177 is displaced from the connected position to the removed position. Next, by gripping the gripping portion 131B of the ink containing body 63 and pulling up the ink containing body 63 from the movable member 177 in the Z axis direction, the ink supply set 50A can be removed from the ink supply apparatus 4.

With the ink supply set 50A of Working Example 1, it is possible to replace the ink containing body 63 with a new ink containing body 63 in the case where the ink of the ink containing body 63 is consumed and the remaining amount of ink in the ink containing portion 82 is insufficient. Accordingly, the supply of the ink to the printer 3 can be promptly continued. Also, since it is easy to avoid a case in which the ink is spilled when the ink containing body 63 is replaced, it is easy to avoid a case of contaminating the ink supply apparatus 4 or the printer 3 with ink.

Working Example 2

Figure 15:
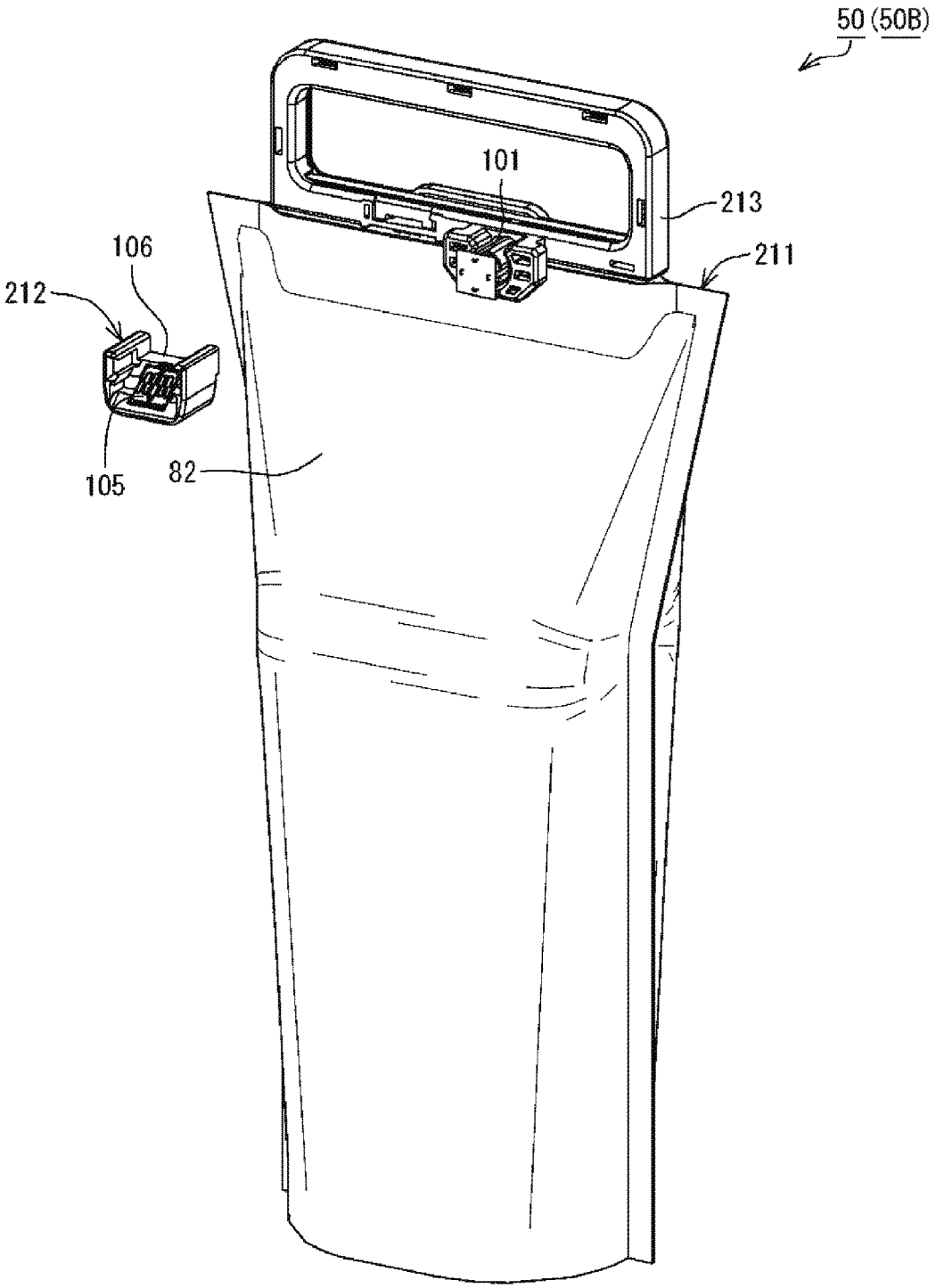
FIG. 15 is a perspective view showing an ink supply set according to Working Example 2.

As shown in FIG. 15, an ink supply set 50B of Working Example 2 has an ink containing body 211 and an electrical contact unit 212. The ink supply set 50B has a mode in which the circuit board 105, along with the substrate installation portion 106, is separated from the connection unit 83 of the ink supply set 50A of Working Example 1. That is, in the ink supply set 50B, the ink guiding portion 101 and the substrate installation portion 106 are independent of each other. Other than this point, the ink supply set 50B of Working Example 2 has a configuration similar to that of the ink supply set 50A of Working Example 1. For this reason, in the description below, configurations that are similar to those of Working Example 1 are denoted by the same reference signs as in Working Example 1, and detailed description thereof is not included.

An ink containing body 211 includes a connection unit 213, and an ink containing portion 82. The connection unit 213 has an ink guiding portion 101. An electrical contact unit 212 includes the substrate installation unit 106 and the circuit board 105. The substrate installation unit 106 is configured to be able to be separated from the connection unit 213. Other than this point, the connection unit 213 has a configuration that is similar to that of the connection unit 83 in Working Example 1.

An example of a mounting method for when the ink supply set 50B is mounted on the mounting/dismounting unit 171 will be described next. With this mounting method, first, when the movable member 177 (FIG. 9) is at the removed position, the substrate installation portion 106 of the electrical contact unit 212 is engaged with the support portion 191 of the movable member 177. At this time, the −Z axis direction can be used as the direction in which the substrate installation portion 106 is engaged with the support portion 191. However, there is no limitation to the −Z axis direction, and the −K1 direction or another direction can be used as the direction in which the substrate installation portion 106 is engaged with the support portion 191.

Next, the ink containing body 211 is supported by the movable member 177. At this time, the method by which the ink containing body 211 is supported by the movable member 177 is similar to that of Working Example 1, and therefore detailed description thereof will not be included here. Next, the movable member 177 is displaced in the −K1 direction, whereby the movable member 177 is displaced from the removed position to the connected position. This makes it possible to connect the ink guiding portion 101 and the ink introduction portion 173 and to connect the contact point mechanism 175 and the terminal portions 107 of the circuit board 105. With the ink supply set 50B of Working Example 2, the ink containing body 211 and the electrical contact unit 212 are independent of each other, and therefore each can be individually replaced. For this reason, when the electrical contact unit 212 is damaged or the like, for example, it is possible to replace only the electrical contact unit 212 with a new electrical contact unit 212. Accordingly, it is easy to avoid a case in which the ink containing body 211 goes to waste. In this way, with this ink supply set 50B, constituent components are not likely to go to waste.

Note that in Working Example 2, the substrate installation portion 106 can be configured to be detachable from the connection unit 213. With this configuration, for example, the electrical contact unit 212 and the ink containing body 211 can be supported by the movable member 177 after the electrical contact unit 212 is mounted on the ink containing body 211. Accordingly, it is easy to reduce the burden associated with mounting/dismounting the ink supply set 50B on/from the mounting/dismounting unit 171.

Working Example 3

Figure 16:
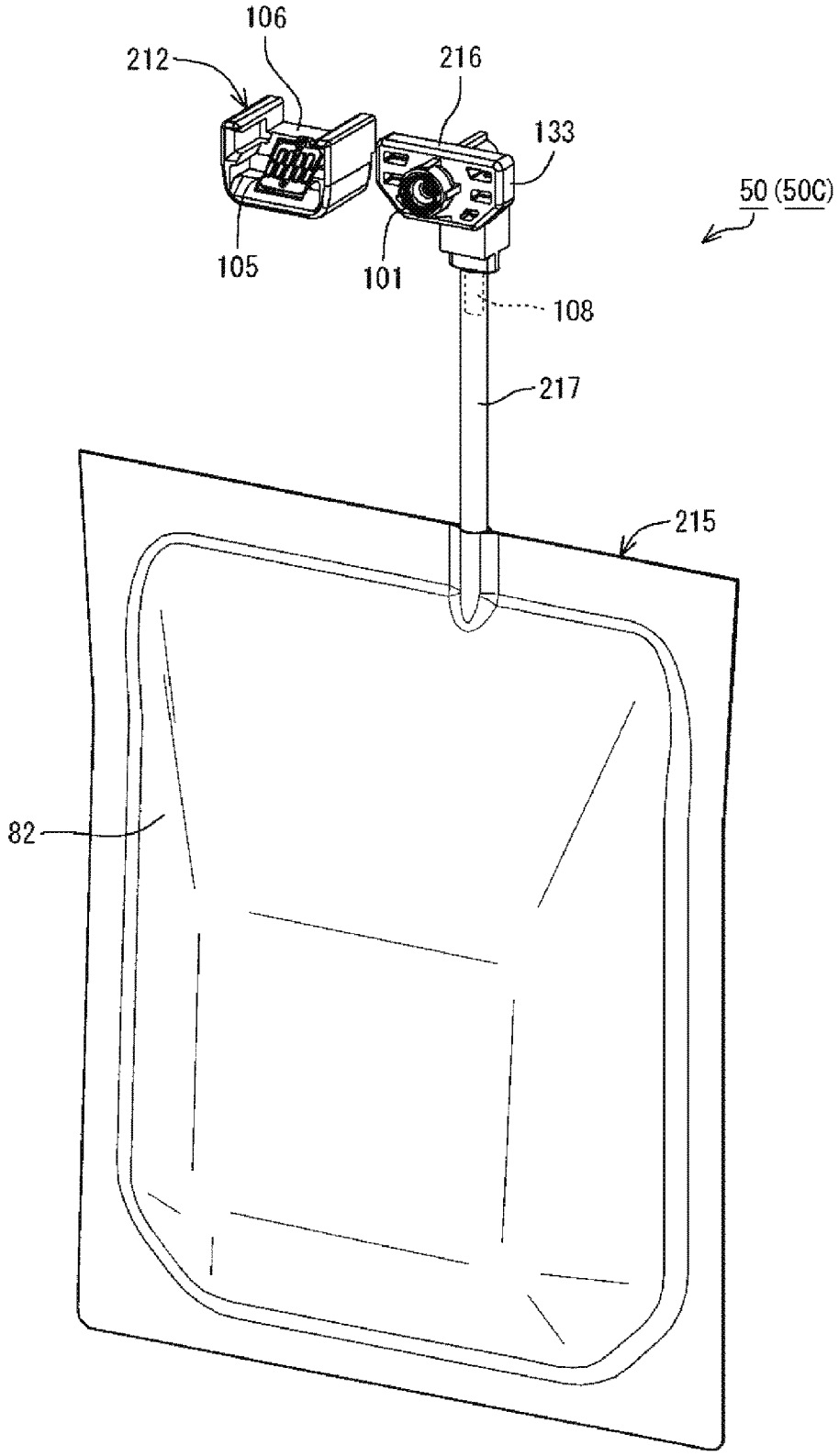
FIG. 16 is a perspective view showing an ink supply set according to Working Example 3.
Figure 17:
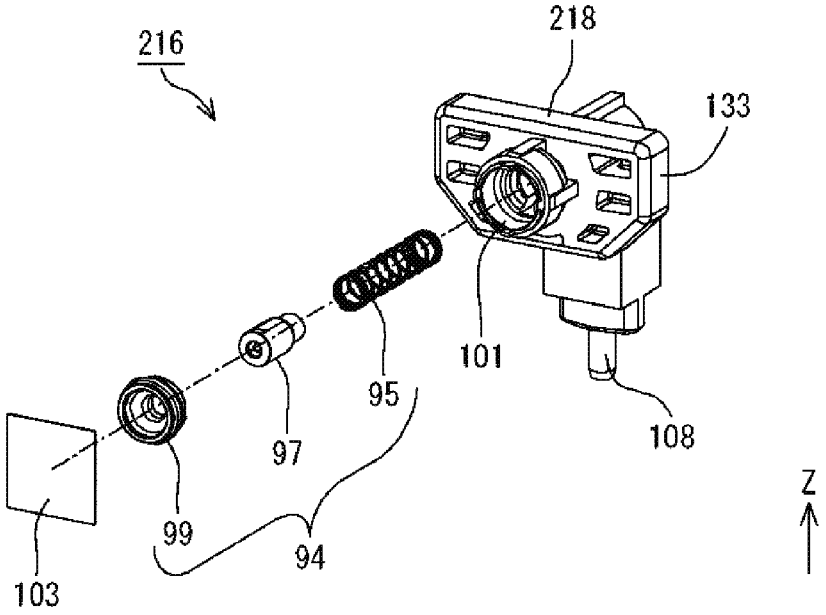
FIG. 17 is an exploded perspective view showing an ink guiding unit according to Working Example 3.

As shown in FIG. 16, an ink supply set 50C of Working Example 3 has an ink containing body 215 and an electrical contact unit 212. In Working Example 3, configurations similar to those of Working Example 1 and Working Example 2 are denoted by the same reference numerals as in Working Example 1 and Working Example 2 and detailed description thereof is not included. The ink containing body 215 has an ink containing portion 82, an ink guiding unit 216, which is an example of a liquid guiding unit, and a flow path unit 217. As shown in FIG. 17, the ink guiding unit 216 has a connection member 218 and a valve unit 94. The connection member 218 has an ink guiding portion 101, an introduction port 108, and an engaging portion 133. The valve unit 94 is similar to that of Working Example 1, and therefore description thereof is not included here. Note that the ink guiding portion 101 is closed by the film 103 in the state in which the ink containing body 215 has not yet been mounted in the ink supply apparatus 4.

As shown in FIG. 16, the flow path unit 217 connects the ink containing portion 82 and the ink guiding unit 216. One end of the flow path unit 217 is connected to the ink containing portion 82. The other end of the flow path unit 217 is connected to the introduction port 108 (FIG. 17) of the ink guiding unit 216. The flow path unit 217 is constituted by a flexible tube or the like, for example, and forms a flow path that guides the ink in the ink containing portion 82 to the ink guiding unit 216. The ink guided from the ink containing portion 82 to the ink guiding unit 216 via the flow path unit 217 is guided from the introduction port 108 to the ink guiding portion 101.

An example of a mounting method for when the ink supply set 50C is mounted on the mounting/dismounting unit 171 will be described. With the ink supply set 50C, a sequence in which the electrical contact unit 212 is engaged to the movable member 177 before the ink containing body 215 is and a sequence in which the ink containing body 215 is engaged to the movable member 177 before the electrical contact unit 212 is can both be used. When the ink containing body 215 is supported by the movable member 177, the engaging portion 133 of the ink guiding unit 216 is engaged in the recessed portion 187 of the movable member 177. Accordingly, the ink guiding unit 216 is supported by the mounting/dismounting unit 171. Note that by adding the configuration in which the ink containing portion 82 is supported by the ink supply apparatus 4, it is possible to reduce the load applied to the portion connecting the flow path unit 217 and the ink containing portion 82.

The method by which the electrical contact unit 212 is supported by the movable member 177 is similar to that of Working Example 2, and therefore detailed description thereof will not be included here. Also, by displacing the movable member 177 in the −K1 direction after the electrical contact unit 212 and the ink containing body 215 are supported by the movable member 177, the movable member 177 is displaced from the removed position to the connected position. This makes it possible to connect the ink guiding portion 101 and the ink introduction portion 173 and to connect the contact point mechanism 175 and the terminal portions 107 of the circuit board 105. With the ink supply set 50C of Working Example 3, the ink guiding unit 216 and the electrical contact unit 212 are independent of each other, and therefore each can be individually replaced. Accordingly, for example, when the ink guiding unit 216 is damaged or the like, it is possible to replace only the ink guiding unit 216 with a new ink guiding unit 216. Also, for example, when the circuit board 105 is damaged or the like, it is possible to replace only the circuit board 105 with a new circuit board 105 by replacing the electrical contact unit 212. In this way, with this ink supply set 50C, it is easy to avoid a case in which constituent components go to waste.

Working Example 4

Figure 18:
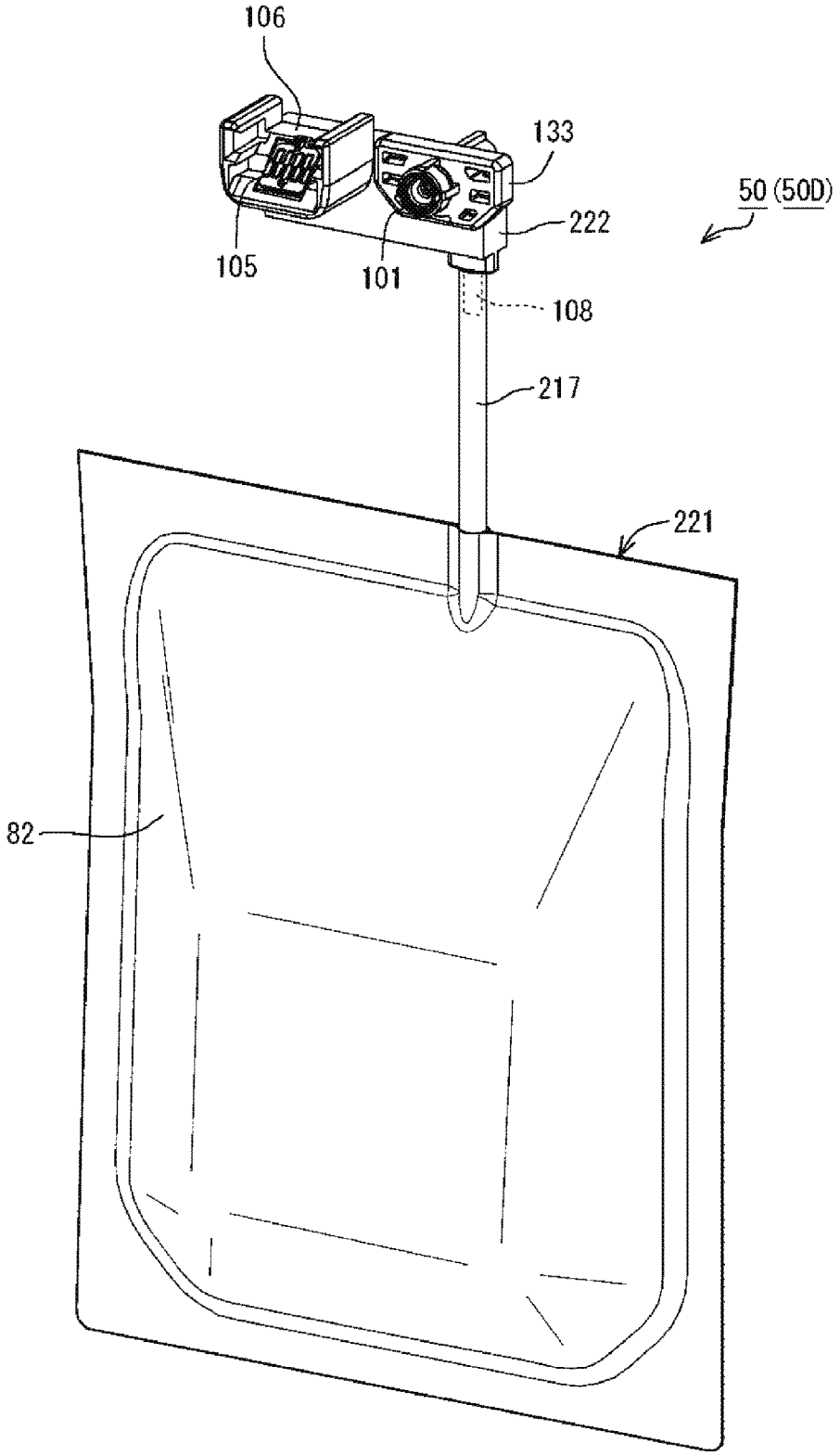
FIG. 18 is a perspective view showing an ink supply set according to Working Example 4.

As shown in FIG. 18, an ink supply set 50D of Working Example 4 has an ink containing body 221. The ink supply set 50D has a mode in which the electrical contact unit 212 and the ink guiding unit 216 of the ink supply set 50C in Working Example 3 are coupled. In other words, in the ink supply set 50D, the ink guiding portion 101 and the substrate installation portion 106 are configured integrally. Other than this point, the ink supply set 50D of Working Example 4 has a configuration similar to that of the ink supply set 50C of Working Example 3. For this reason, in the description below, configurations that are similar to those of Working Example 3 are denoted by the same reference signs as in Working Example 3, and detailed description thereof is not included.

Figure 19:
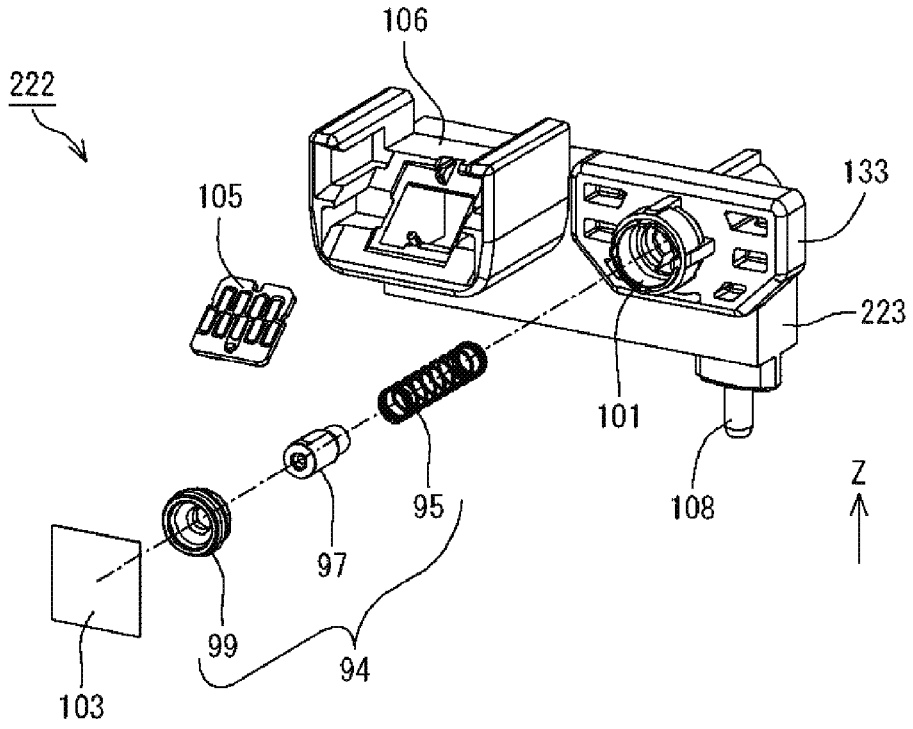
FIG. 19 is an exploded perspective view showing a connection unit according to Working Example 4.

The ink containing body 221 has a connection unit 222, an ink containing portion 82, and a flow path unit 217. The connection unit 222 has a mode in which the electrical contact unit 212 (FIG. 16) and the ink guiding unit 216 of the ink supply set 50C in Working Example 3 are coupled. As shown in FIG. 19, the connection unit 222 has a connection member 223, a valve unit 94, and a circuit board 105. The connection member 223 has an ink guiding portion 101, an introduction port 108, an engaging portion 133, and a substrate installation portion 106. The valve unit 94 and the substrate installation portion 106 are similar to those of Working Example 1, and therefore description thereof is not included here. Note that the ink guiding portion 101 is closed by the film 103 in the state in which the ink containing body 221 has not yet been mounted in the ink supply apparatus 4.

An example of a mounting method for when the ink supply set 50D is mounted on the mounting/dismounting unit 171 will be described. With the ink supply set 50D, similarly to Working Example 1, the engaging portion 133 of the connection member 223 is first engaged with the recessed portion 187 of the movable member 177. At this time, the substrate installation portion 106 of the connection member 223 is inserted into the cut-out portion 192 (FIG. 9) of the movable member 177. Next, by displacing the movable member 177 from the removed position to the connection position, it is possible to connect the ink guiding portion 101 and the ink introduction portion 173, and to connect the contact point mechanism 175 and the terminal portions 107 of the circuit board 105.

Note that in Working Example 4 as well, similarly to Working Example 3, by adding the configuration in which the ink containing portion 82 is supported by the ink supply apparatus 4, it is possible to reduce the load applied to the portion connecting the flow path unit 217 and the ink containing portion 82. It is also possible to use a configuration in which the handle portion 131 of Working Example 1 and Working Example 2 is added to the connection unit 222. With this configuration, a worker can grip the gripping portion 131B to hold the ink containing body 221, which makes handling the ink containing body 221 convenient.

With the ink supply set 50D in Working Example 4, the connection unit 222 and the ink containing unit 82 are independent of each other. Also, with the ink supply set 50D, the connection unit 222 and the ink containing unit 82 are in communication with each other via the flow path unit 217. For this reason, the connection unit 222 and the ink containing portion 82 can each be replaced individually. Accordingly, for example, when the ink guiding portion 101 is damaged or the like, it is possible to replace only the connection unit 222 with a new connection unit 222. For this reason, with this ink supply set 50D, it is easy to avoid a case in which the ink in the ink containing portion 82 goes to waste. Also, for example, when the ink containing portion 82 is damaged or the like, it is possible to replace only the ink containing portion 82 with a new ink containing portion 82. For this reason, with this ink supply set 50D, it is easy to avoid a case in which a constituent component other than the ink containing portion 82 goes to waste.

Variation 1

In Working Example 1 to Working Example 4, a configuration was used in which the ink containing portion 82 and the ink introduction portion 173 are in communication with each other due to the ink guiding portion 101 being connected to the ink introduction portion 173. However, the configuration in which the ink containing portion 82 and the ink introduction portion 173 are in communication is not limited to this. As the configuration in which the ink containing portion 82 and the ink introduction portion 173 are in communication, it is also possible to use a configuration in which the ink containing portion 82 and the ink introduction portion 173 are in communication due to the other end of the flow path unit 217, which is connected to the ink containing portion 82, being directly coupled to the supply needle 121. The configuration in which the other end of the flow path unit 217, which is connected to the ink containing portion 82, is directly coupled to the supply needle 121 is Variation 1. In Variation 1 as well, it is possible to supply the ink in the ink containing portion 82 to the printer 3. Also, in Working Example 1, the ink guiding portion 101 can be omitted, and therefore the number of components can be reduced.

Variation 2

Figure 20:
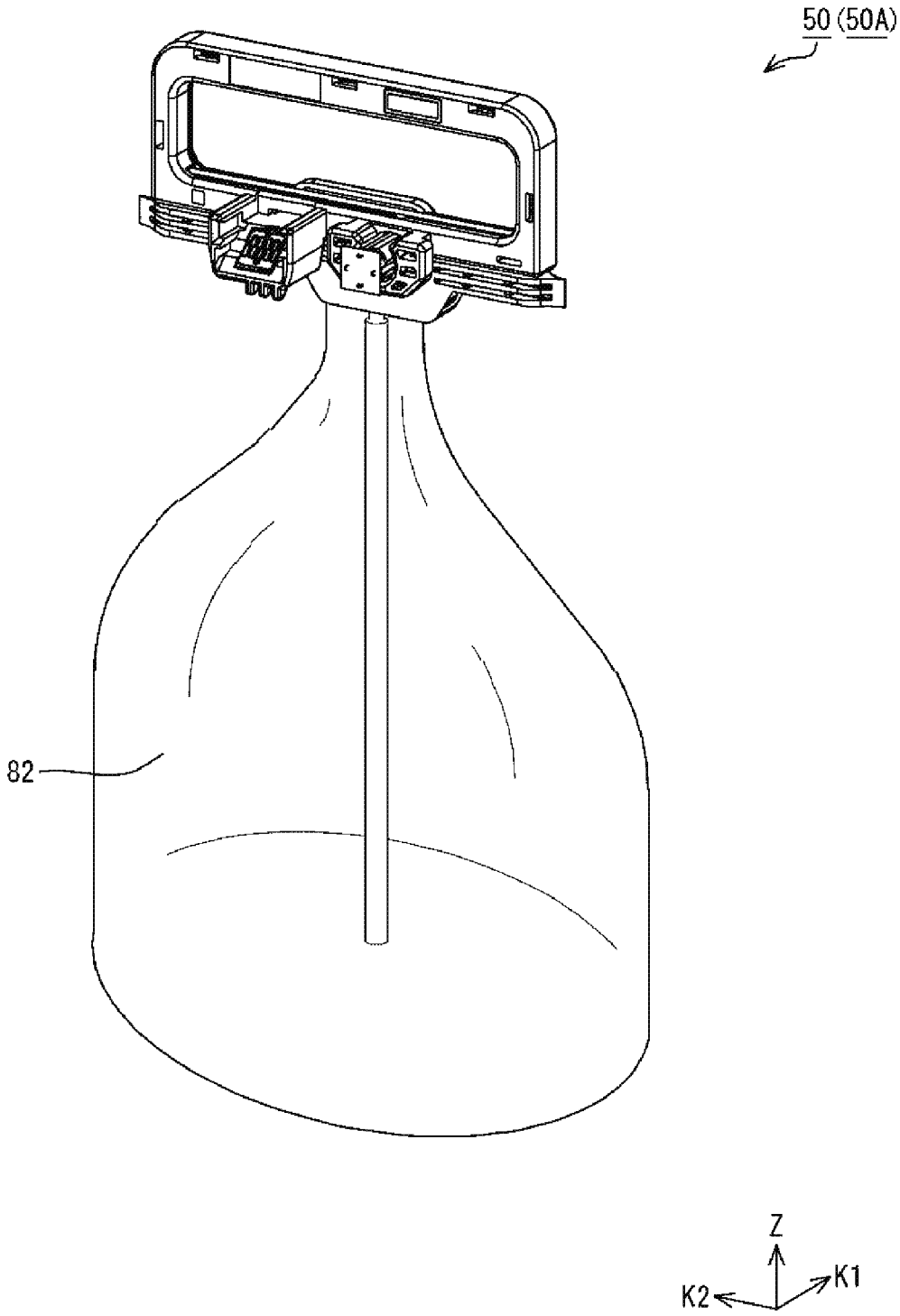
FIG. 20 is a perspective view showing an ink containing portion according to Variation 2.

Working Example 1 to Working Example 4 and Variation 1 showed examples in which the ink containing portion 82 is formed by joining the film material 82A, the film material 82B, and the film material 82C, which are flexible. However, the configuration of the ink containing portion 82 is not limited to this. For example, as shown in FIG. 20, it is also possible to use a flexible container formed using blow molding, or the like, as the configuration of the ink containing portion 82. Note that FIG. 20 illustrates an example in which a container formed using blow molding is applied to the ink supply set 50A of Working Example 1. The example shown in FIG. 20 is Variation 2. In Variation 2 as well, a similar effect is obtained.

Variation 3

Also, the ink containing unit 82 is not limited to being a flexible container formed using blow molding, and it is also possible to use a highly-rigid container formed using injection molding of resin, or the like. The example in which the ink containing portion 82 is constituted by a highly-rigid container formed using injection molding of resin or the like is Variation 3. In Variation 3 as well, a similar effect is obtained.

Variation 4

In Working Example 1 to Working Example 4 and Variation 1 to Variation 3, it is also possible to use a configuration in which an air communication path through which air can be introduced in the ink containing portion 82 is provided. The example in which an air communication path through which air can be introduced into the ink containing portion 82 is provided is Variation 4. With the configuration of Variation 4, air can be introduced into the ink containing portion 82 via the air communication path, and therefore it is possible to reduce a drop in pressure in the ink containing portion 82 that occurs when the ink in the ink containing portion 82 is consumed. Note that in Variation 4, for example, a hole that penetrates from the inner portion to the outer portion of the ink containing portion 82 is formed in the ink containing portion 82, and this hole can be used as the air communication path. Also, for example, the air communication path can be formed by adding a component in which a flow path, through which air can be introduced into the ink containing portion 82, is formed.

Variation 5

In Working Example 1 to Working Example 4 and Variation 1 to Variation 4, it is also possible to use a configuration in which an ink introduction path through which ink can be introduced in the ink containing portion 82 is provided. The example in which an ink introduction path through which ink can be introduced into the ink containing portion 82 is provided is Variation 5. Note that the ink introduction path is an example of a liquid introduction path. With the configuration shown in Variation 5, the ink can be introduced into the ink containing portion 82 via the ink introduction path, and therefore it is possible to inject new ink into the ink containing portion 82. Note that in Variation 5, for example, a hole that penetrates from the inner portion to the outer portion of the ink containing portion 82 is formed in the ink containing portion 82, and this hole can be used as the ink introduction path. Also, for example, the ink introduction path can be formed by adding a component in which a flow path is formed, through which ink can be injected into the ink containing portion 82.

Variation 6

In Variation 4, the air communication path can also be used as the ink introduction path. The example in which the air communication path is also used as the ink introduction path is Variation 6. In Variation 6, ink can be introduced into the ink containing portion 82 via the air communication path, through which air can be introduced into the ink containing portion 82. Also, with the configuration of Variation 6, air can be introduced into the ink containing portion 82 via the air communication path, and therefore it is possible to reduce a drop in the pressure in the ink containing portion 82 that occurs when the ink in the ink containing portion 82 is consumed. With Variation 6, air and ink can be introduced into the ink containing portion 82 with a simple configuration.

REFERENCE SIGNS LIST

1 Liquid ejection system
3 Printer
4 Ink supply apparatus
5 Conveying device
6 Recording unit
7 Moving device
9 Relay device
11 Control unit
12A Driving roller
12B Driven roller
13 Conveying motor
17 Carriage
19 Recording head
31 Flexible cable
41A, 41B Pulley
43 Timing belt
45 Carriage motor
47 Guide shaft
50, 50A, 50B, 50C, 50D Ink supply set
53 Case
57 Ink supply tube
59 Pump unit
61 Ink supply tube
63 Ink containing body
82 Ink containing portion
82A, 82B, 82C Film material
83 Connection unit
85 Circumferential edge region
86 Welded portion
91 Connection member
93 Tube
94 Valve unit
95 Spring
97 Plug
99 Gasket
101 Ink guiding portion
102 Base portion
103 Film
105 Circuit board
106 Substrate installation portion
107 Terminal portion
108 Introduction port
109 Bottom portion
111 Side wall
113 Opening portion
115 Groove
117 Terminal end
121 Supply needle
123 Flow path
131 Handle portion
131A Leg portion
131B Gripping portion
133 Engaging portion
171 Mounting/dismounting unit
172 Holder
173 Ink introduction portion
175 Contact point mechanism
177 Movable member
183 Support portion
185 Cut-out portion
187 Recessed portion
191 Support portion
192 Cut-out portion
207 End surface
211 Ink containing body
212 Electrical contact unit
213 Connection unit
215 Ink containing body
216 Ink guiding unit
217 Flow path unit
218 Connection member
221 Ink containing body
222 Connection unit
223 Connection member

The invention claimed is:

1. A liquid supply set configured to detach from a liquid supply apparatus that supplies a liquid to a liquid ejection apparatus, comprising:

a liquid containing portion configured to contain the liquid;

a connection unit configured to detach from the liquid supply apparatus;

a liquid guiding portion provided in the connection unit;

a flow path connection portion that is provided in the connection unit and communicates with the liquid guiding portion;

a flow path unit that constitutes a flow path that connects the liquid containing portion and the flow path connection portion and is configured to guide the liquid in the liquid containing portion to the liquid guiding portion via the flow path connection portion;

an electrical contact portion configured to come into contact with an electrical connection portion provided in the liquid supply apparatus; and a holding portion that is provided in the connection unit and is configured to hold the electrical contact portion, wherein the liquid guiding portion includes a first engaging portion configured to engage with the liquid supply apparatus, the liquid supply apparatus includes a liquid introduction portion into which the liquid in the liquid containing body is introduced via the liquid guiding portion, and a movable support portion configured to support the connection unit, a first engaged portion with which the first engaging portion of the liquid guiding portion engages is formed in the movable support portion, in a state in which the first engaging portion of the liquid guiding portion is engaged with the first engaged portion, the electrical contact portion comes into contact with the electrical connection portion in the connected position, and is separated from the electrical connection portion in the removed position.

2. The liquid supply set according to claim 1, wherein at least part of the liquid containing portion is flexible.

3. The liquid supply set according to claim 1, wherein the liquid containing portion is provided with an air communication path through which air is introduced into the liquid containing portion.

4. The liquid supply set according to claim 1, wherein the liquid containing portion is provided with a liquid introduction path through which liquid is introduced into the liquid containing portion.

5. A liquid supply apparatus that supplies a liquid to a liquid ejection apparatus, comprising:

a liquid containing portion configured to contain the liquid;

a liquid introduction portion into which the liquid is introduced from the liquid containing portion;

a connection unit configured to connect to the liquid introduction portion;

a liquid guiding portion provided in the connection unit;

a flow path connection portion that is provided in the connection unit and communicates with the liquid guiding portion;

a flow path unit that constitutes a flow path that connects the liquid containing portion and the flow path connection portion and is configured to guide the liquid in the liquid containing portion to the liquid guiding portion via the flow path connection portion;

an electrical connection portion;

an electrical contact portion configured to come into contact with the electrical connection portion;

a holding portion that is provided in the connection unit and is configured to hold the electrical contact portion; and a movable support portion configured to detachably support the connection unit, wherein the liquid guiding portion includes a first engaging portion configured to engage with the movable support portion, a first engaged portion with which the first engaging portion of the liquid guiding portion engages is formed in the movable support portion, in a state in which the first engaging portion of the liquid guiding portion is engaged with the first engaged portion, the movable support portion is displaced from a removed position in which the liquid guiding portion and the liquid introduction portion are separated from each other, to a connected position at which the liquid guiding portion and the liquid introduction portion are connected to each other, and in a state in which the first engaging portion of the liquid guiding portion is engaged with the first engaged portion, the electrical contact portion comes into contact with the electrical connection portion in the connected position, and is separated from the electrical connection portion in the removed position.

6. The liquid supply apparatus according to claim 5, further comprising a cover that covers the liquid containing portion.

7. The liquid supply apparatus according to claim 6, wherein the cover covers the flow path unit.

8. A liquid ejecting system, comprising:

the liquid supply apparatus according to claim 5;

a liquid ejection portion configured to eject the liquid supplied from the liquid supply apparatus via the liquid introduction portion; and a pump that is provided between the liquid introduction portion and the liquid ejection portion, and is configured to provide pressure to the liquid from the liquid introduction portion side to the liquid ejection portion side.

* * * * *